US007443092B2

(12) United States Patent
Yamada et al.

(10) Patent No.: US 7,443,092 B2
(45) Date of Patent: Oct. 28, 2008

(54) FLUORESCENT LAMP INCLUDING A MULTI-RINGED BULB

(75) Inventors: Ichiro Yamada, Kanagawa-Ken (JP); Naoyuki Toda, Kanagawa-Ken (JP); Kiyoshi Nishimura, Kanagawa-Ken (JP); Yusuke Shibahara, Kanagawa-Ken (JP); Kiyoshi Ootani, Kanagawa-Ken (JP); Masahiko Yoshida, Kanagawa-Ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 521 days.

(21) Appl. No.: 10/535,824

(22) PCT Filed: Nov. 21, 2003

(86) PCT No.: PCT/JP03/14947

§ 371 (c)(1),
(2), (4) Date: May 23, 2005

(87) PCT Pub. No.: WO2004/049388

PCT Pub. Date: Jun. 10, 2004

(65) Prior Publication Data

US 2006/0071601 A1 Apr. 6, 2006

(30) Foreign Application Priority Data

Nov. 22, 2002 (JP) ..... 2002-339912
Jun. 13, 2003 (JP) ..... 2003-168924
Jul. 10, 2003 (JP) ..... 2003-273092

(51) Int. Cl.
*H01J 1/62* (2006.01)
*H01J 63/04* (2006.01)
*H01K 1/28* (2006.01)

(52) U.S. Cl. ..... 313/493; 220/2.1 R

(58) Field of Classification Search ..... None
See application file for complete search history.

(56) References Cited

U.S. PATENT DOCUMENTS 4,337,414 A * 6/1982 Young ..... 315/56
4,458,301 A 7/1984 Chapman et al.

(Continued)

FOREIGN PATENT DOCUMENTS

DE 42 03 594 A1 10/1992

(Continued)

OTHER PUBLICATIONS

U.S. Appl. No. 11/125,180, filed May 10, 2005, Shibahara et al.
U.S. Appl. No. 10/535,824, filed May 23, 2005, Yamada et al.

*Primary Examiner*—Karabi Guharay
*Assistant Examiner*—Britt Hanley
(74) *Attorney, Agent, or Firm*—Oblon, Spivak, McClelland, Maier & Neustadt, P.C.

(57) ABSTRACT

There is provided a multi-ringed bulb including a plurality of ring bulbs in which a plurality of straight tube portions having an outside diameter of from 12 to 20 mm are connected to each other through bent portions on a same plane. Electrodes are provided hermetically at respective ends of outermost and innermost bulbs of the plurality of ring bulbs. A connection portion connects other adjacent ends of the outermost and innermost bulbs to each other so that the outermost and innermost bulbs communicate with each other, to form a single discharge path. A phosphor layer is formed on inner surfaces of at least the straight tube portions 5*a* of the inner and outer bulbs. The multi-ringed structure bulb is filled with discharge medium. The above-mentioned structure permits to provide a fluorescent lamp and a lighting apparatus, which have a small strain in the inner and outer bulbs, a high strength and an excellent luminous efficiency.

12 Claims, 20 Drawing Sheets

U.S. PATENT DOCUMENTS

| | | | | |
|---|---|---|---|---|
| 4,549,251 | A * | 10/1985 | Chapman et al. | 362/216 |
| 5,034,655 | A | 7/1991 | Murayama et al. | |
| 5,220,249 | A * | 6/1993 | Tsukada | 315/246 |
| 5,723,939 | A * | 3/1998 | Okuno et al. | 313/493 |
| 6,118,217 | A | 9/2000 | Hammer et al. | |
| 6,175,187 | B1 * | 1/2001 | Tsutsui | 313/493 |
| 6,630,779 | B1 * | 10/2003 | Tokes et al. | 313/493 |
| 2005/0212399 | A1 * | 9/2005 | Holst | 313/493 |
| 2005/0253526 | A1 * | 11/2005 | Shibahara et al. | 313/634 |
| 2006/0164000 | A1 * | 7/2006 | Nishimura et al. | 313/489 |

FOREIGN PATENT DOCUMENTS

| | | | |
|---|---|---|---|
| DE | 198 29 270 | A1 | 1/1999 |
| EP | 0 720 208 | A2 | 7/1996 |
| EP | 1 160 829 | | 12/2001 |
| JP | 58-103760 | | 6/1983 |
| JP | 58-152366 | | 9/1983 |
| JP | 59-20959 | | 2/1984 |
| JP | 61-126733 | | 6/1986 |
| JP | 62-133663 | | 6/1987 |
| JP | 63-164158 | | 10/1988 |
| JP | 2-3649 | | 1/1990 |
| JP | 6-187948 | | 7/1994 |
| JP | 8-273607 | | 10/1996 |
| JP | 9-320525 | | 12/1997 |
| JP | 10-92383 | | 4/1998 |
| JP | 2000-348677 | | 12/2000 |
| JP | 2001-345065 | | 12/2001 |
| JP | 2002-170526 | | 6/2002 |
| JP | 2002-245808 | | 8/2002 |

* cited by examiner

Background Art

FLUORESCENT LAMP INCLUDING A MULTI-RINGED BULB

TECHNICAL FIELD

The present invention relates to a fluorescent lamp and a lighting apparatus utilizing such a fluorescent lamp.

BACKGROUND OF THE INVENTION

As a conventional double-ringed fluorescent lamp, there is known, for example, as shown in FIG. 21, a double-circular fluorescent lamp 321. In such a double-circular fluorescent lamp 321, there is provided, on the outer side of an inner ring glass bulb 322 having ring shape, an outer ring glass bulb having a ring shape and a larger diameter than the inner ring glass bulb so as to be placed concentrically on the same plane. A connection portion 324 connects respective discharge paths of the inner and outer ring glass bulbs 322, 323 to each other to form a single discharge path so that an increased length of the discharge path can enhance the total luminous flux and the luminous efficiency (as disclosed, for example, following Patent Document 1).

Such a kind of fluorescent lamp has an increased length of the discharge path in comparison with the other lamp, which is composed of a single ring bulb, thus enhancing the total luminous flux and the luminous efficiency.

Patent Document 1: Japanese Patent Laid-open (KOKAI) Publication No. HEI 9-129180.

However, in a manufacturing process of the conventional double-circular fluorescent lamp 321 disclosed in the above Patent Document 1, a protection layer and a phosphor layer are formed on inner surfaces of two straight tubular glass bulbs 322, 323, and then these bulbs are heated to be softened and wound around cylindrical drums so as to be bent into a ring shape. Accordingly, there is a problem that fissure, flaking off or crack may easily occur on the protection layer or the phosphor layer.

After completion of the ring-shape bending process for the ring glass bulbs 322, 323, the connection portion 324 is formed. However, it is not always easy to carry out the formation process of the connection portion 324, and the strength of the connection portion 324 is apt to be deteriorated, thus causing problems. More specifically, the inner and outer ring glass bulbs 322, 323 are heated so as to be softened in their entirety and subjected to the bending process. Then, flame from a burner is blown onto portions of these bulbs, on which the connection portion 324 is to be formed, to heat them locally to soften, and at this time, gas is blasted into the glass bulbs 322, 323 so that bulb walls thereof project outward under the function of the gas pressure and are broken by blast to form apertures thereon. Then, the blast-broken ends of these portions as projected outward are connected to each other by fusion (i.e., the burner blast breaking) so that these apertures communicate with each other to form the connection portion 324.

The heating process through the burner blast breaking is carried out to blow the flame from the burner onto the portions of the inner and outer ring glass bulbs 322, 323, on which the connection portion is to be formed, to heat them to soften, in a state that residual strain caused by the heating in the bending process still exists on the glass bulbs 322, 323 in their entirety. As a result, damage such as crack may easily occur on the connection portion 324 or in the vicinity thereof. The glass bulbs 322, 323 are provided on their respective ends with groove portions "m" formed thereon, which are utilized to carry out the bending process. The connection portion 324 cannot be formed in the vicinity of the groove portion "m" and must be formed apart from the end of the bulb. This leads to a decreased length of the discharge paths of the bulbs 322, 323, thus deteriorating the luminous efficiency.

In addition, the burner blast breaking process must be carried out to couple partially a convexly arched outer surface of the inner ring glass bulb 322 and a concavely arched inner surface of the outer ring glass bulb 323 to each other in a narrow gap (for example, of from 1 mm to 3 mm) between the inner and outer ring glass bulbs 322, 323, so as to form the connecting portion 324, as shown in FIG. 22. Therefore, it is not easy to carry out the coupling operation due to difference in radius of curvature between the opposing circumferential surfaces of the bulbs, thus causing problems.

Each of the inner and outer ring glass bulbs 322, 323 is formed into a ring shape as shown in FIGS. 21 and 22, and there is formed a space having a trapezoidal shape between the outer end surfaces 327*a*, 328*a*, in the axial direction of the tube, of electrode-sealed end portions 327, 328 by which a pair of electrodes 325, 326 are sealed, respectively, and the opposing outer end surfaces 329*a*, 330*a* on the side of the connecting portion 324 in the circumferential direction so that the distance "La" between the end surfaces 327*a* and 329*a* is smaller than the distance "Lb" between the end surfaces 328*a* and 330*a*.

The increased distances "La", "Lb" on the side of the outer peripheral surfaces in such a trapezoidal space results in the decreased length of the discharge path of the whole fluorescent lamp 21. Accordingly, a non-luminous or dark area is increased, a base 331, which is mounted between the electrode-sealed end portions 327, 328 and the opposing ends on the side of the connecting portion 324 so as to cover them, is formed into a fan shape and has a large size, thus causing problems.

DISCLOSURE OF THE INVENTION

An object of the present invention, which was made in view of the above-described circumstances encountered in the prior art, is therefore to provide a fluorescent lamp and a lighting apparatus, which have a small strain in bulb, a high strength and an excellent luminous efficiency.

A fluorescent lamp of the present invention comprises:

a multi-ringed structure bulb including: a plurality of ring bulbs in which a plurality of straight tube portions having an outside diameter of from 12 to 20 mm are connected to each other through bent portions on a same plane, the ring bulbs being placed concentrically on the same plane; electrodes provided hermetically at respective ends of outermost and innermost bulbs of the plurality of ring bulbs; and a connection portion connecting other adjacent ends of the outermost and innermost bulbs to each other so that the outermost and innermost bulbs communicate with each other to thereby form a single discharge path;

a phosphor layer formed on inner surfaces of at least the straight tube portions of the multi-ringed structure bulb; and a discharge medium with which the multi-ringed structure bulb is filled.

Each of the ring bulbs is composed, into a polygon such as a rectangular shape, of the plurality of straight tube portions and the bent portions through which the straight tube portions are connected to each other. The bent portion may be formed by partially bending a single straight bulb, or carrying out a mold-forming when connecting the ends of the straight bulbs to each other, or connecting bent bulbs having for example a U-shape or L-shape to each other or in combination with the straight bulbs.

The straight tube portion has the outside diameter of from 12 to 20 mm and the optimum outside diameter thereof is within the range of from 14 to 18 mm, taking into consideration lamp characteristic property such as luminous efficiency and manufacturing conditions. Although it is conceivable that the outside diameter of the straight tube portion, which is disposed in the vicinity of the bent portion, may vary slightly during the forming process of the bent portion and be partially out of the above-mentioned range, only a requirement that the outside diameter of the straight tube portion for the most part is within the above-mentioned range, suffices in the present invention.

It is known that the decreased diameter of the fluorescent lamp generally enhances the luminous efficiency. In the present invention, the outside diameter of the straight tube portion is limited to 20 mm or less. The outside diameter of the straight tube portion of 20 mm or less can provide luminous efficiency, which is comparable to or higher than the conventional smaller-diameter circular structure fluorescent lamp.

With the outside diameter of the straight tube portion of less than 12 mm, it is difficult to ensure the mechanical strength for the glass bulb having the bent portion, resulting in inapplicability. In addition, luminous power, which is comparable to the conventional circular structure fluorescent lamp having the same size, cannot be obtained, resulting in impracticality.

In order to enhance the luminous efficiency of the conventional circular fluorescent lamp (type name of "FCL") having the outside diameter of 29 mm by at least 10%, it is necessary to reduce the outside diameter thereof to 65% or less. More specifically, the outside diameter of the straight tube portion of 18 mm or less suffices. Such an outside diameter can provide satisfactorily a low-profile fluorescent lamp. It is preferable to limit the outside diameter of the straight tube portion to 14 mm or more, taking into consideration the characteristic properties such as luminous power and luminous efficiency.

The ring bulbs each of which is formed of a single bulb have at least three respective straight tube portions. The number of the bent portions through which the straight tube portions are connected to each other in their inside, is smaller than the number of the straight tube portions by one. The bent portions are disposed between the plurality of straight tube portions so that the straight tube portions are disposed on substantially the same plane.

The ring bulb is formed into a ring shape so as to surround the center of the polygon. Concentric connection of the ring bulbs forms the single discharge path, which surrounds the center of the ring bulbs several times. More specifically, the straight tube portions of each of the ring bulbs are connected to each other in their inside through the bent portions, and a pair of electrodes are arranged at the respective ends of the ring bulbs so as to form a single discharge path. All the straight tube portions need not always to have the same length and only one of them may have the different length. When the four straight tube portions having the same length are connected through three bent portions, the straight tube portions of the bulb forms a rectangular shape. In this case, the outside ring bulb has the rectangular shape, which is larger than that of the inside ring bulb.

According to the present invention, in the manufacturing process of the ring bulb, a single elongated straight bulb having the inner surface on which layers such as a phosphor layer has previously formed is heated locally only at bent-portion-formation prearrangement portions, i.e., portions of the ring bulb, on which the connection portions are to be formed, and alternatively, only the corresponding ends of a plurality of straight bulbs, which are to be connected to form the connection portion, are heated locally, and the remaining portions of the bulb are not subjected to a heating process. It is therefore possible to restrain the deterioration of the phosphor caused by the heating of the whole ring bulb, enhance the initial luminous flux and improve the luminous flux maintenance factor. The local heating of the bulb provides a reduced strain of glass and an increased strength thereof.

Even when the connection portion is formed at the corresponding end portions of the ring bulbs by the burner blast breaking process, the straight tube portions of the ring bulbs have a low strain in glass, thus making it possible to prevent cracks from occurring on the bulbs during the connection process and improve the strength of the connection portion.

In addition, the discharge path sections of the plurality of ring bulbs are connected by means of the connection portion to thereby form a single discharge path, thus making it possible to increase the length of the discharge path and enhance both of the total luminous flux and the luminous efficiency.

In a preferable case of the fluorescent lamp, the ring bulb is formed by bending a single straight tube bulb, the straight tube bulb has a tube length of from 800 to 2500 mm, and a length of a bent-portion-formation prearrangement portion, which is to be formed into the bent portion, is within the range of from 15 to 50% of a total length of the straight tube bulb.

Deterioration of the initial luminous flux is restrained effectively, with an increased ratio of the total length of the straight tube portions, which are not susceptible to the deterioration of the phosphor caused by heat, relative to the full length of the bulb, thus providing an improved effect in luminous power. In view of this fact, the length of the bent-portion-formation prearrangement portion, which is to be thereafter formed into the bent portion, is limited to 50% or less of the total length of the straight tube bulb. With the length of the bent-portion-formation prearrangement portion of over 50%, the deterioration of the phosphor caused by heat during the bending process becomes serious, thus reducing an improved effect in luminous power. On the other hand, with the length of the bent-portion-formation prearrangement portion of less than 5%, particularly less than 15%, it becomes difficult to carry out the bending process and ensure the desired mechanical strength of the bent portion.

The length of the bent-portion-formation prearrangement portion, which is to be formed into the bent portion, is within the range of from 5 to 50% of a total length of the straight tube bulb so as to ensure an appropriately increased total length of the straight tube portions having the phosphor layer, which is not susceptible to the deterioration caused by heat, thus making it possible to provide the fluorescent lamp, which can be manufactured easily, and has an ensured mechanical strength and a remarkably improved effect in luminous power.

In a preferable case of the fluorescent lamp, each of the straight tube portions has a length "l" of from 150 to 500 mm and a radius of curvature "r" of the bent portion satisfies an expression of "$0.03 \leqq r/l \leqq 0.3$.

The fluorescent lamp of the present invention utilizes, as a main luminous power, light radiation from the straight tube portions in which the phosphor layer is not susceptible to the deterioration caused by heat, resulting in necessity to ensure the length "l" of the straight tube portion as large as possible. In order to obtain appropriate illuminance for a lighting apparatus for common use, the length "l" of the straight tube portion is set within the range of from 150 to 500 mm, and preferable of from 180 to 400 mm.

The radius of curvature "r" of the inner surface of the bent portion represents a size of the bent portion, with the result that the length of the bent-portion-formation prearrangement portion increases with increasing radius of curvature "r" and the luminous power reduces accordingly. To the contrary, the smaller radius of curvature "r" leads to a larger degree of deformation of the bulb during the formation of the bent portion, resulting in difficulty in the manufacture and the possible deterioration of the strength of the bulb. In view of these facts, the present inventors have carried out extensive studies about a balance between the luminous power and formability of the bent portion and obtained findings that the optimum balance can be obtained by limiting the ratio of the radius of curvature "r" relative to the length "l" of the straight tube portion within a predetermined range.

In case where the length "l" of the straight tube portion is within the range of from 150 to 500 mm, with the ratio "r/l" of the radius of curvature "r" of the inner surface of the bent portion relative to the length "l" of the straight tube portion of less than 0.03, a degree of deformation of the bent portion becomes large, resulting in difficulty in the manufacture. In addition, the strength of the bent portion is decreased due to factors that, when stress of deformation is applied to the bulb, the bent portion is susceptible to local stress concentration, leading to a possible breakage thereof. Therefore, the above-mentioned condition is not acceptable. On the other hand, with the ratio "r/l" of over 0.3, the ratio of the bent portion relative to the ring bulb increases, with the result that influence due to the deterioration of the phosphor caused by heat becomes large, thus leading to a reduced luminous efficiency. Therefore, such a condition is not acceptable.

The radius of curvature "r" of the bent portion satisfies the expression of "$0.03 \leqq r/l \leqq 0.3$" in this manner in the case where the length "l" of the straight tube portion is within the range of from 150 to 500 mm, thus making it possible to easily form the bent portion and minimize the influence due to the deterioration of the phosphor of the bent portion, which is caused by heat, to effectively utilize the luminous power from the straight tube portion.

In a preferable case of the fluorescent lamp, the multi-ringed bulb comprises a double-tube bulb having inner and outer bulbs, electrode-side outer ends of the inner and outer bulbs at which a pair of electrodes are hermetically provided, respectively, and other outer ends thereof, which has the connection portion, are spaced apart from each other by a predetermined distance so as to face each other, and a base is disposed on one ends and other ends of the bulbs so as to cover respective ends thereof.

Here, the phrase "the outer ends . . . so as to face each other" means not only a case where the respective outer ends of the bulbs face each other so that the straight tube portions by which the end sides of the respective bulbs are formed are aligned with each other in their axes, but also another case where the respective outer ends of the bulbs do not face directly each other, but face each other by an angle so that the axes of the straight tube portions by which the end sides of the respective bulbs are formed, intersect at an angle of about 90 degrees.

The electrode-side outer ends of the inner and outer bulbs at which the paired electrodes are hermetically provided, respectively, and other outer ends thereof, which has the connection portion, are spaced apart from each other by a predetermined distance so as to face each other, thus making it possible to decrease the gap between the opposite ends and increase the length of the discharge path as large as possible. This also makes it possible to reduce the dark areas at the opposite ends and make size and weight reduction of the bases, which are mounted at the opposite ends.

In a preferable case of the fluorescent lamp, the inner and outer bulbs connected to each other through the connection portion are cut by fusion at the other outer ends thereof and closed hermetically, and the minimum length from the outer ends to the connection portion is equal to or less than 15 mm.

The whole of inner and outer bulbs are not bent, resulting in that there is no need to form any groove for a chuck as in the conventional circular bulb and the end of the bulb can be sealed by a fusion cutting. Here, the fusion cutting of the end of the bulb means the heating of the intermediate portion of the bulb in a molten state to thermally bond the pipe walls of the bulb together at around the central axis of the bulb, thus providing a seal utilizing only the material of the bulb, without using a separate sealing member such as a dummy stem. The sealed end of the bulb, which is formed by the fusion cutting, may have a shape with a flat surface in parallel with the perpendicular direction to the axial direction of the bulb or may have a projecting hemispherical shape. The fusion cutting of the end of each of the bulb makes it possible to decrease the minimum length between the outer end of each of the other ends of the inner and outer bulbs (i.e., the other ends thereof on the side of the connection portion) and the connection portion to 15 mm or less, thus reducing the dark area. It is therefore possible to increase the luminescent area of the bulb and the length of the discharge path thereof by the reduced length of the dark area.

In a preferable case of the fluorescent lamp, each of the inner and outer bulbs is formed into a rectangular shape and both electrode-side ends of the inner and outer bulbs extend to corners of the rectangular shape.

This enables the dark area due to shade of the electrode to be positioned within the base so as to be covered with the base, thus enhancing luminous intensity of the fluorescent lamp. The electrode-side ends of the inner and outer bulbs extend toward the connection portion-side ends thereof, thus making it possible to increase the total lengths of the inner and outer bulbs by the extended lengths as mentioned above and increasing the length of the discharge path.

When the both electrodes are arranged outside of the corner portions of the fluorescent lamp having the rectangular shape, the luminescent area is provided at all the corners of the rectangular shape (i.e., the four corners). Accordingly, even when the fluorescent lamp emits light at any angle around the center of the rectangular shape, the light emission always occurs at each of the respective corner portions (i.e., the four corners). Thus, uniformity ratio of illuminance of the entire fluorescent lamp can be improved in this manner.

In a preferable case of the fluorescent lamp, the bulbs are filled with mercury vapor serving as the discharge medium, the connection portion is provided so that a least a part of the connection portion is substantially flush with the other outer ends of the inner and outer bulbs, and the electrode for the outer bulb extends to a position apart from the end thereof by a distance, which is larger than a distance by which the electrode for the inner bulb extends to a position apart from the end thereof.

This causes the discharge path to be formed also in the vicinity of the end surfaces of the other ends of the inner and outer bulbs, thus leading to occurrence of light emission around the end surfaces. It is therefore possible to increase the luminescent area of the luminescent lamp and the length of the discharge path.

The electrode for the outer bulb extends to a position apart from the end thereof by the distance, which is larger than the distance by which the electrode for the inner bulb extends to a position apart from the end thereof, so that the cold spot can be generated in the vicinity of the electrode-sealed end portion of the outer bulb to control the pressure of the mercury vapor.

In addition, in a preferable case of the fluorescent lamp, the electrode-side outer end of at least one of the inner and outer bulbs terminates at a position, which is disposed on an inner side in an axial direction of the bulb relative to the electrode-side outer end of the other bulb, and electricity receiving devices are arranged on an outer surface of the base covering both the electrode-side outer ends of the inner and outer bulbs in corresponding positions in a space extending outward from the electrode-side outer end of the one of the inner and outer bulbs in the axial direction thereof.

This makes it possible to provide base pins such as the electricity receiving devices on the outer surface of the base in a space extending outward from the electrode-side outer end of the one bulb in the axial direction thereof, thus leading to an effective utilization of the space and providing the base having a smaller size.

The fluorescent lamp of the present invention may further comprise a second electrode disposed at the end of the bulb, which corresponds to an intermediate position of the discharge path.

When the starting voltage from a glow switch device is applied between any one of the paired electrodes (hereinafter referred to as the "first electrodes") provided at the ends of the bulbs, which correspond to the opposite positions of the single discharge path formed in the bulbs, and the second electrode, the discharge occurs in a part of the discharge path. The length between the one of the first electrodes and the second electrode is smaller than the length of the discharge path of the whole luminescent tube so that the starting voltage between the one of the first electrodes and the second electrode is lower in comparison with the case where starting voltage is applied between the first electrodes of the illumination tube. Subsequent occurrence of the discharge on the other of the first electrodes makes it possible to reduce the general starting voltage of the illumination tube.

In the present invention, the distance between the one of the first electrodes and the second electrode is smaller than that between the pair of electrodes. When, prior to the occurrence of the discharge between the pair of electrodes to illuminate the fluorescent lamp, the discharge is caused to occur between the one of the first electrodes and the second electrode of the bulbs, and the discharge is then caused to occur between the pair of electrodes, the starting voltage for the illumination tube can be reduced. Alternatively, it is possible to cause a primary discharge for illumination to occur only between the one of the first electrodes and the second electrode, to provide a dimmer illumination of the fluorescent lamp.

In a preferable case of the fluorescent lamp, centers of radii of curvature of inner and outer surfaces of bent portions of the inner and outer bulbs substantially coincide with each other and the bent portions have a diameter, which is substantially identical to the diameter of the straight tube portions disposed in the vicinity of the bent portions.

The double-tube bulb is constructed by combining the inner ring bulb and the outer ring bulb together, which have similar figures to each other, but are different in the maximum ring diameter from each other. The inner and outer ring bulbs are connected to each other at their ends through the connection portion in a state that they are placed concentrically with each other so that the corresponding bent portions face each other.

The ring bulbs are connected to each other so that the centers of radii of curvature of the inner and outer surfaces of the bent portions of the inner and outer bulbs substantially coincide with each other, and the centers of radii of curvature of the inner and outer bulbs also substantially coincide with each other. The phrase "the centers of radii of curvature of . . . substantially coincide with each other" means that the centers of radii of curvature are identical to each other or slightly displaced from each other. In term of the functions of the present invention, it is acceptable that the distance between the centers is equal to or less than 10% of the radius of curvature, and preferably, equal to or less than 5% thereof.

The radii of curvature of the corresponding bent portions of the inner and outer ring bulbs substantially coincide with each other so that the distance between the adjacent bulbs is substantially identical with each other over the bent portions and the straight portions. In this case, it is also acceptable that the distance between the centers is equal to or less than 10% of the radius of curvature, and preferably, equal to or less than 5% thereof.

Substantial coincidence of the centers of radii of curvature of the bent portions of the inner and outer ring bulbs, when these bulbs are connected concentrically with each other, makes it possible to ensure the state that the distance between the adjacent bent portions is substantially equal to the distance between the adjacent straight portions, in comparison with the case where the plurality of fluorescent lamps having the same radius of curvature of the bent portions, are arranged in the same manner. Therefore, an improved external appearance can be provided and luminance can be made uniform. It is preferred to limit the distance between the bent portions as well as the distance between the straight portions within the range of from 3.0 to 10 mm.

The tube diameter of the bent portion is substantially identical to the tube diameter of the straight portion. The tube diameter of the bent portion is defined on the basis of a tube diameter on a cross-sectional plane of the bulb tube, which is perpendicular to a direction that is directed radially from the center of an imaginary ring-shaped plane along and in parallel therewith, and when the tube is out-of-round, but slightly flattened, it is defined on the basis of an average tube diameter. The phase "substantially identical" means that the tube diameter of the bent portion is up to plus or minus 10% of the tube diameter of the straight portion.

Such formation of the bent portions causes a person to visually recognize as if the bent portions of the ring bulb in its external appearance continue from the straight tube portion to form a curved line. Therefore, an improved external appearance of the luminescent tube can be provided and there is no formation of a local area having a lower temperature, when illuminating. As a result, the cold spot cannot be generated easily, and the bent portion is not susceptible to occurrence of blackening or stain due to condensed mercury.

The length of the straight tube bulb is substantially identical to the length of the discharge path. In view of obtaining luminous power, which is comparable to the conventional smaller-circular structure fluorescent lamp, the length of the straight tube bulb is within the range of from 800 to 2500 mm.

In a preferred case of the fluorescent lamp, each of the ring bulbs is formed into a rectangular shape by four straight tube portions, three bent portions are placed at three diagonal positions of the rectangular shape and the base is placed at a remaining one diagonal position thereof.

This makes it possible to provide a light source in which the main luminescent areas are formed on the respective sides of the rectangular shape. The base is placed on the diagonal line of the rectangular shape, thus making it possible to increase the length of the luminescent area as large as possible. In addition, limitation of the number of bent portions to three can provide an easy formation of the bulb.

In a preferred case of the fluorescent lamp, each of the ring bulbs is formed into a rectangular shape by five straight tube portions, the bent portions are placed at diagonal positions of the rectangular shape and the base is placed at a central position of one side of the rectangular shape.

This makes it possible to provide a light source in which the main luminescent areas are formed on the respective sides of the rectangular shape. The base is placed at the central position of the one side of the rectangular shape so that the opposite end portions of the bulb is aligned with each other in the same line, thus providing a structure for easily mounting the base.

In another aspect, the lighting apparatus of the present invention comprises: a main body; the plurality of fluorescent lamps as described above; and a high frequency lighting circuit, which supplies lamp electricity to the fluorescent lamps at a high frequency of at least 10 kHz.

The main body may be a ceiling surface mounted type, a ceiling pendant type or a wall surface mounted type, or a type provided with a glove, a shade or a reflector, or a type provided with an exposed type fluorescent lamp or a light guiding plate.

BEST MODE FOR EMBODYING THE INVENTION

Figure 1:
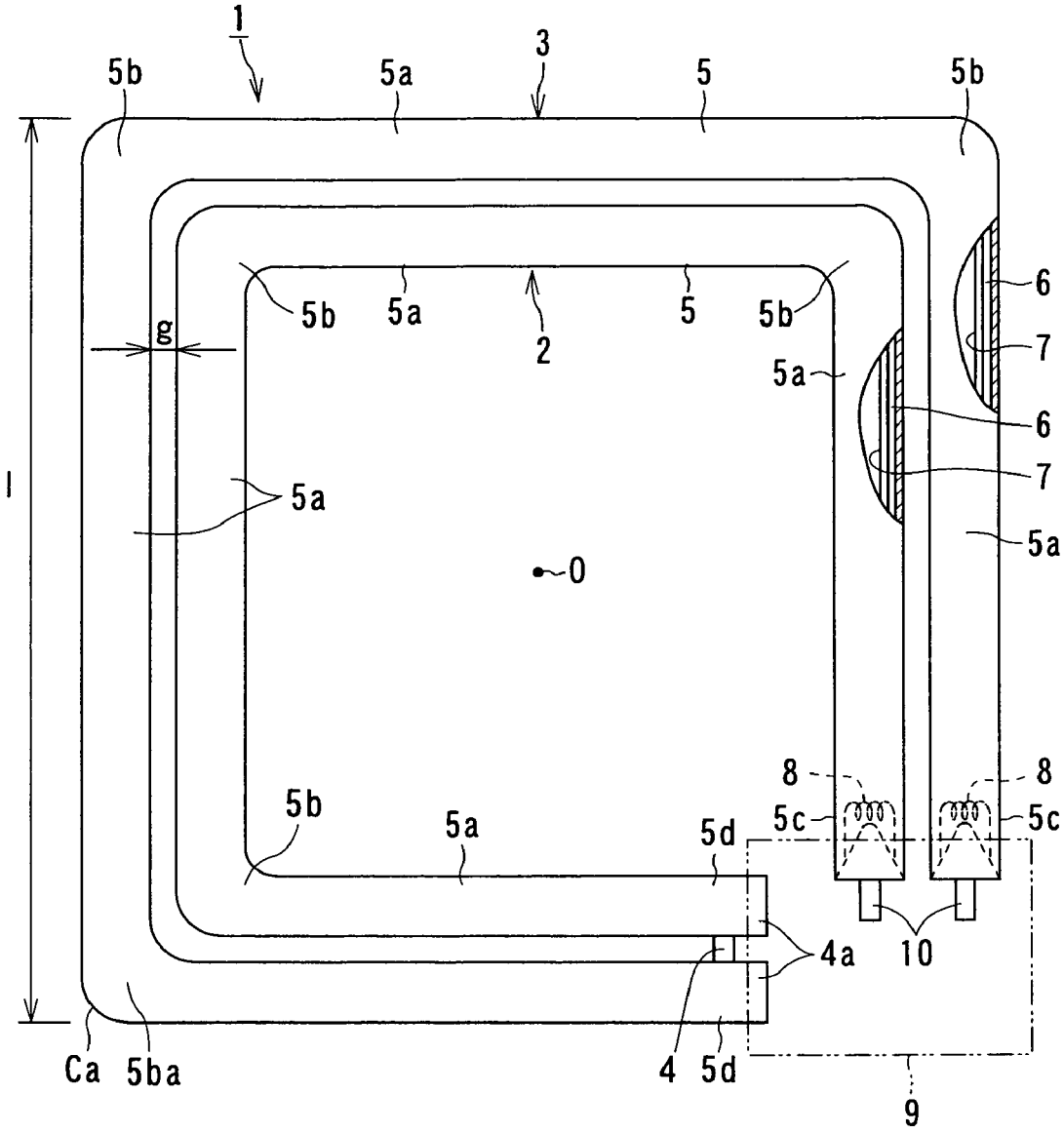
FIG. 1 is a front view of a fluorescent lamp according to a first embodiment of the present invention.

Hereunder, preferred embodiments of fluorescent lamps and lighting apparatus of the present invention will be described in detail with reference to the accompanying drawings. In the drawings, the same reference numerals are given to the same or corresponding components and repetitive description will be omitted with the exception of specifically required description.

FIG. 1 is a front view of the fluorescent lamp 1 according to the first embodiment of the present invention. The fluorescent lamp 1 is structured by disposing, outside an inner bulb 2 having a rectangular shape in its front view, an outer bulb 3 having a rectangular shape, which is slightly larger than the inner bulb 2 and substantially similar thereto so as to be placed concentrically with the inner bulb 2 at a predetermined gap "g" and connecting these bulbs to each other through a connection portion 4 to thereby form a single unit of double tube (a double-tube bulb).

These inner and outer bulbs 2 and 3 are formed of glass bulbs 5, 5, respectively, each of which is composed of four straight tube portions, each having a circular cross section, substantially into a square shape so that an intersecting point of diagonal lines of this square shape is placed at a point "O". The glass bulbs 5, 5 are formed of soft glass such as soda lime glass or lead glass and they may be formed of hard glass such as borosilicate glass or silica glass.

These glass bulbs 5, 5 are filled with discharge medium including a rare gas and mercury. The rare gas is argon (Ar) gas and its charging pressure is about 320 Pa. The rare gas with which the inner and outer bulbs 2, 3 are filled, may include argon, neon or krypton. At least one of the glass bulbs 5, 5 may include amalgam therein. The amalgam is an alloy of mercury and material, which can be alloyed with the mercury. The amalgam of, for example, zinc-mercury may be included for the charge of mercury at a required amount. The amalgam may have a shape of pellets, columns or plates.

The amalgam is received in small tubes provided in stems, which are attached to the ends of the glass bulbs 5, 5. The amalgam is stationarily placed or received in any one of these positions through a melting process or a mechanically holding member. Alternatively, the amalgam may be received in the bulb so as to be movable therein. By disposing the amalgam such as Bi—Sn—Pb or Bi—In for controlling the pressure of mercury vapor in the glass bulbs 5, 5, the fluorescent lamp 1 can be lightened at the optimum state even when the ambient temperature becomes relatively high.

Each of the glass bulbs 5 is provided on its inner surface with a protective layer 6, which includes metallic oxide particles, i.e., alumina ($Al_2O_3$) fine particles and has a thickness of about 1.0 μm. The protective layer 6 is preferably composed of the metallic oxide particles, for which known particles such as alumina ($Al_2O_3$) or silica ($SiO_2$) may be used. The protective layer 6 is provided on its inner surface with a phosphor layer 7 that includes three band fluorescent type phosphor particles and is formed all over the length of the protective layer. The phosphor layer 7 is formed in a thickness of about 20 μm by applying the three band fluorescent type phosphor particles having a correlated color temperature of 5000K in an amount of from 4.0 to 7.5 mg/cm$^2$, preferably of from 6.0 to 7.5 mg/cm$^2$, and subjecting them to a drying and sintering process.

The fluorescent lamp 1 is not a lamp, which is bent in its entirety as in the conventional circular structure fluorescent lamp, but is merely subjected to a local bending process. It is therefore possible to increase an applied amount of phosphor and minimally restrain the layer from being peeled off, thus providing an increased thickness of the phosphor layer 7. Accordingly, the initial luminous flux can be enhanced.

It is preferable to previously form the phosphor layer 7 on at least the straight portion 5*a*, prior to the formation of the bent portion 5*b*. However, the present invention is not limited only to such a preferable case, and the phosphor layer 7 may be formed after the formation of the bent portion 5*b*. Known phosphor such as three-band fluorescent type phosphor or halophosphate are applicable as the phosphor for forming the phosphor layer 7. It is however preferable to use the three-band fluorescent type phosphor in view of luminous efficiency.

Concerning the three-band fluorescent type phosphor, $BaMg_2Al_{16}O_{27}:Eu^{2+}$is applicable as the blue type phosphor having a luminescent peak wavelength in the vicinity of 450 nm, (La, Ce, Tb)$PO_4$ as the green type phosphor having the luminescent peak wavelength in the vicinity of 540 nm, and $Y_2O_3:Eu^{3+}$as the red type phosphor having the luminescent peak wavelength in the vicinity of 610 nm. However, the present invention is not limited only to use of these materials or substances.

Each of the glass bulbs 5 has four straight tube portions 5*a* and three bent portions 5*b*, which are placed in an interconnecting state on the same plane so that the four straight tube portions 5*a* form the respective sides of a square shape. In this case, it is preferable to determine the length "l" of one side of the square shape the glass bulb 5 as 200 mm or more, and in this embodiment of the present invention, the above-mentioned length "l" is about 300 mm. The respective ends 5*c* of the glass bulbs 5 are closely placed substantially in parallel with each other, and filament electrodes 8, 8 which are formed of a triple coil on which emitter material has been applied, are attached to the above-mentioned respective ends 5*c* to form electrode-sealed end portions 5*c*.

The electrodes 8, 8 are supported by means of lead wires, which are supported in a sealed state by means of flare stems, button stems, bead stems or pinch sealing members. Fine tubes for exhausting or filling mercury alloy may be connected to such stems or members.

Each of the straight tube portions 5*a* has a tube inside diameter of from 12 to 20 mm and a thickness of from 0.8 to 1.5 mm, and in the embodiment of the present invention, the tube inside diameter is of about 16 mm and the thickness is of about 1.2 mm. The straight tube portions 5*a* communicate with each other through the bent portions 5*b*, and the end portions 5*d*, which are placed in opposite to the electrode-sealed end portions 5*c* in the axial directions thereof, are connected to each other through a connection portion 4 so as to communicate with each other to thereby form a single discharge path, which twice surrounds the center "O" of the square shape in a passage extending from one electrode 8 of the inner bulb 2, through the connection portion 4, to the other electrode 8 of the outer bulb 3. The connection portion 4 is formed by applying a burner blast breaking process to the connection portion-side end portions 5*d*, 5*d* of the inner and outer bulbs 2, 3, which are placed on the side of the connection portion 4.

The inner and outer bulbs 2 and 3 are structured so that the cold spot is generated in at least one bent portion 5*b*, or the connection portion-side end portions 5*d*, 5*d*, which are furthest apart from the electrodes 8, 8, when the fluorescent lamp 1 is illuminated. The cold spot is generated in a region of the bulb having the lowest temperature, when the fluorescent lamp 1 is illuminated. Accordingly, the bent portion 5*b* may have a structure in which temperature increase is not apt to occur when the fluorescent lamp 1 is illuminated, so as to ensure generation of the cold spot. Such a structure is exemplified by forming a space so as to be apart from the discharge path or providing a surface area having an excellent heat radiation effect than the other portions. The bent portion 5*b* has a smaller surface area ratio relative to the total surface area of the bulbs 5, 5 than the straight tube portion 5*a*, with the result that a luminescence power is small and its shape can be formed as desired, thus making it possible to easily apply the structure in which temperature increase is not apt to occur to the bent portion. It is therefore possible to easily control the temperature of the cold spot generated in the bent portion 5*b* on the basis of the desired temperature. Therefore, the optimum pressure of mercury vapor can be ensured even at a high ambient temperature, thus permitting a further enhancement of luminous efficiency. With the controlling of the pressure of mercury vapor on the basis of the temperature of the cold spot, in an alternation, the pressure of mercury vapor may be controlled by means of amalgam.

The both of the connection portion-side end portions 5*d*, 5*d* of the inner and outer bulbs 2, 3 are placed to face both the electrode-sealed end portions 5*c*, 5*c* thereof, respectively, so that the respective axial lines intersect at an angle of about 90 degrees, and a base 9 is mounted so as to straddle a region among these end portions 5*d*, 5*d*, 5*c*, 5*c*. The base 9 is provided with an incoming device having for example four pins, which are to be electrically connected to the pair of electrodes 8, 8. The base 9 has an electric connection element such as incoming pins, which is to be connected to a power supply device such as a socket. The electric connection element may be provided in a position apart from the opposite ends of the bulbs 5, 5. The base 9 may have a structure, which enables the base to attain the function as a holding device in a mechanical connection to the power supply device. The bent portions 5*b* are provided at three corners of the square shape arrangement, which is formed by the straight tube portions 5*a* of each of the glass bulbs 5, and the base 9 is placed at the remaining one corner. In FIG. 1, the reference numeral "10" denotes an exhaust pipe.

The fluorescent lamp 1 having the above-described structure is illuminated by the action of a not-shown high frequency lighting circuit.

The high frequency lighting circuit may be provided with a switching device. The switching device may have a mode in which the fluorescent lamp is illuminated with high efficiency and another mode in which the lamp is illuminated at a high output. The switching device may have a function of causing a continuous variation between these modes. A switching operation of the switching device of the lighting circuit adjusts illuminance of the fluorescent lamp 1. In an example case in which the switching device has the high efficiency illuminance mode and the high output illuminance mode, the fluorescent lamp 1 may be used in an appropriate selection of mode in accordance with conditions of use.

The fluorescent lamp 1 is mounted in compliance with a shape of the main body of the lighting apparatus and optical properties thereof. In addition, the plurality of fluorescent lamps having the same or different shape are fitted in combination to the main body so that they are placed on the same plane or at different levels from each other.

The operation of the embodiment of the present invention will be described hereunder.

High frequency voltage is inputted to the base 9 and an arc discharge occurs in the path extending from the electrode 8 of the inner bulb 2 to the electrode 8 of the outer bulb 3 through the connection portion 4, thus causing the fluorescent lamp 1 to be illuminated. When the fluorescent lamp 1 is illuminated, the cold spot is generated in at least one bent portion 5*b*, for example, the bent portion 5*ba*, which is furthest apart from the pair of electrodes 8, 8, or in the connection portion-side end portion 5*d* in the vicinity of the connection portion 4. Condition that the temperature of the outer surface of the cold spot is within the range of, for example, from about 40 to 65° C. suffices. Maintenance of the temperature of the cooled zone within the above-mentioned range can provide the optimum pressure of mercury vapor for the fluorescent lamp 1, thus permitting illuminance with high luminous efficiency.

According to the fluorescent lamp 1 of the present invention, the discharge path of the inner bulb 2 is connected to the discharge path of the outer bulb 3 to form a single discharge path. It is therefore possible to extend about twice the discharge path of the whole fluorescent lamp, in comparison with the inner and outer bulbs 2, 3 provided in the form of a single tube and enhance about twice the total luminous flux, thus enhancing the luminous efficiency. In addition, according to the fluorescent lamp 1, after the phosphor layer 7 has been formed on the inner surface of the glass bulb 5, only the bent-portion-formation prearrangement portion, on which the connection portion is to be formed, is subjected to a local heating. It is therefore possible to restrain deterioration of phosphor caused by heat, enhance the initial luminous flux and improve the luminous flux maintenance factor.

In the embodiment of the present invention, the glass bulb 5 of each of the inner and outer bulbs 2, 3 is formed into a square shape by partially or locally binding the single elongated straight bulb. However, each of the glass bulb 5 may be prepared by connecting a plurality of straight tube bulbs to form bent portions 5*b*. In addition, the glass bulb may be formed into a rectangular shape. In an example case, the end portions of the plurality of straight tube bulbs may be partially heated, melted and then subjected to a blast breaking to form connection portions, and the thus formed connection portions may be thereafter connected to each other and subjected to a molding formation process to form bent portions 5*b* having the desired shape.

Incidentally, there can be used the glass bulb 5 for each of the inner and outer bulbs 2 and 3, which is substantially free from lead element and has a sodium oxide content of 1.0 vol. % or less and a softening temperature of 720° C. or less. Herein, the phrase "substantially free from lead element" means that the incidental impurities may be included at a certain amount, and preferably of 0.1 vol. % or less. In the most preferable case, it is needless to say that glass contains no lead element.

The phrase "has a sodium oxide content of 1.0 vol. % or less" also means that the glass contains no sodium oxide. The reason why the sodium oxide content is determined to be 0.1 vol. % or less is that, with the sodium oxide content exceeding the above-mentioned value, the sodium element deposited on the inner surface of the glass bulb 5 may exert an influence on the luminous power of the fluorescent lamp 1. Glass, which is substantially free from lead element and has the sodium oxide content of 1.0 vol. % or less and the softening temperature of 720° C. or less, can be obtained by adjusting the contents of $K_2O$ and $Li_2O$ and the contents of CaO, MgO, BaO and SrO. Herein, the softening temperature is a temperature at which a relational expression of viscosity "η" of glass $=10^{7.65}$ dPa·s is satisfied.

With the sodium oxide content of glass bulb 5 of over 0.1 vol. %, sodium is deposited in the form of an alkaline element on the inner surface of the glass bulb 5 during illuminance. Deposition of sodium on the inner surface of the glass bulb 5 causes sodium to react with mercury vapor charged in the glass bulb 5 to bring about a colored glass bulb 5, thus deteriorating visible light transmittance, or causes sodium to react with phosphor substance in the phosphor layer 7 to bring about deterioration of the phosphor substance, thus decreasing power of visible light. Particularly, soda lime glass as conventionally used contains sodium oxide of from 15 to 17 vol. %, resulting in severe decrease in power of visible light.

In view of these facts, when the phosphor layer is formed through application on the straight tube bulb, which is formed of glass having the sodium oxide content of 1.0 vol. % or less and the softening temperature of 720° C. or less, for example of 692° C., and then the bent portions are formed, an amount of sodium deposited on the inner surface of the bulb can be remarkably reduced, thus leading to an effective restraint on the decreasing in power of visible light caused by the reaction of the sodium. In addition, the softening temperature of 720° C. or less leads to a lower heating temperature during a bent portion formation process and restraint on deterioration of the surrounding phosphor layer caused by heat, thus enhancing the luminous power.

Each of the glass bulbs 5 used in the embodiment of the present invention has the following chemical composition:

| | |
|---|---|
| SiO | 65.0 vol. %, |
| $Al_2O_3$ | 4.0 vol. %, |
| $Na_2O$ | 0.05 vol. %, |
| $K_2O$ | 11.0 vol. %, |
| $Li_2O_3$ | 2.8 vol. %, |
| CaO | 2.0 vol. %, |
| MgO | 1.4 vol. %, |
| SrO | 5.0 vol. %, |
| BaO | 8.5 vol. %, |
| $SO_3$ | 0.15 vol. %, |
| $B_2O_3$ | 0 vol. %, |
| $Sb_2O_3$ | 0 vol. %, |
| $Fe_2O_3$ | 0.03 vol. %, and |
| the balance | 0.17 vol., and |
| the softening temperature is 692° C. | |

Figure 2:
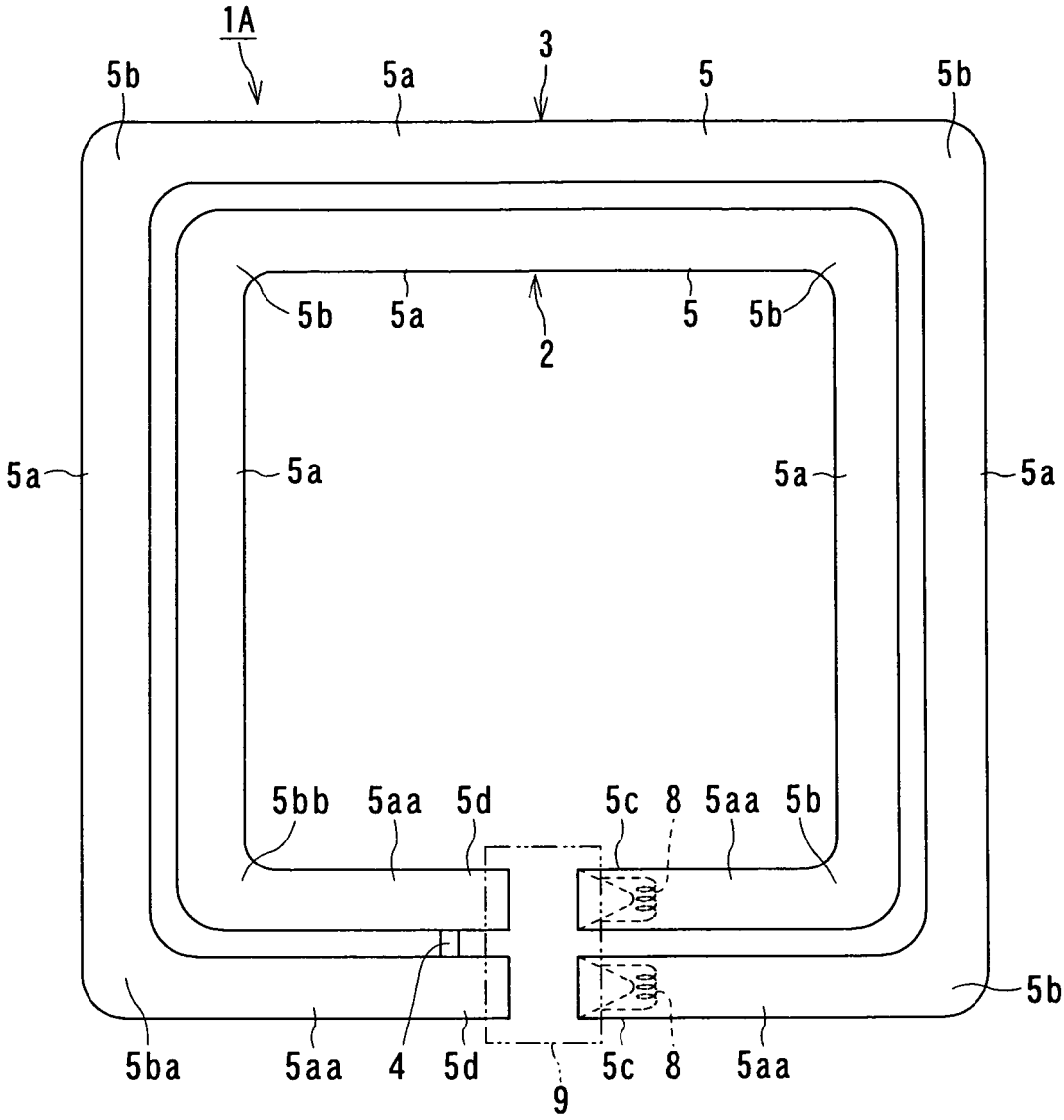
FIG. 2 is a front view of a fluorescent lamp according to a second embodiment of the present invention.

FIG. 2 is a front view of the fluorescent lamp 1A according to the second embodiment of the present invention. The fluorescent lamp 1A is characterized in that each of the inner and outer bulbs 2 and 3 is formed by connecting five straight tube bulbs to each other so as to form four bent portions 5*b*, in the above-described fluorescent lamp 1.

More specifically, in the inner and outer bulbs 2 and 3, one side of the square shape of the respective glass bulb 5 is composed of straight tube portions 5*a* a, 5*a* a each having a half length of the other side thereof, a pair of electrodes 8, 8 are provided on the end portions of the straight tube portions 5*aa*, 5*aa*, respectively, to form the electrode-sealed end portions 5*c*, 5*c*, and on the other hand, the other end portions thereof are provided as the connection portion-side end portions 5*d*, 5*d*, respectively. The base 9 is mounted so as to straddle a region among both the electrode-sealed end portions 5*c*, 5*c* and both the connection portion-side end portions 5*d*, 5*d*. According to the embodiment of the present invention, the base 9 is placed almost in the middle of the one side of the square shape of the glass bulb 5 so that the respective opposite ends of the inner and outer bulbs 2 and 3 face each other in the respective same line, thus providing an easy mounting structure of the base 9.

Figure 3:
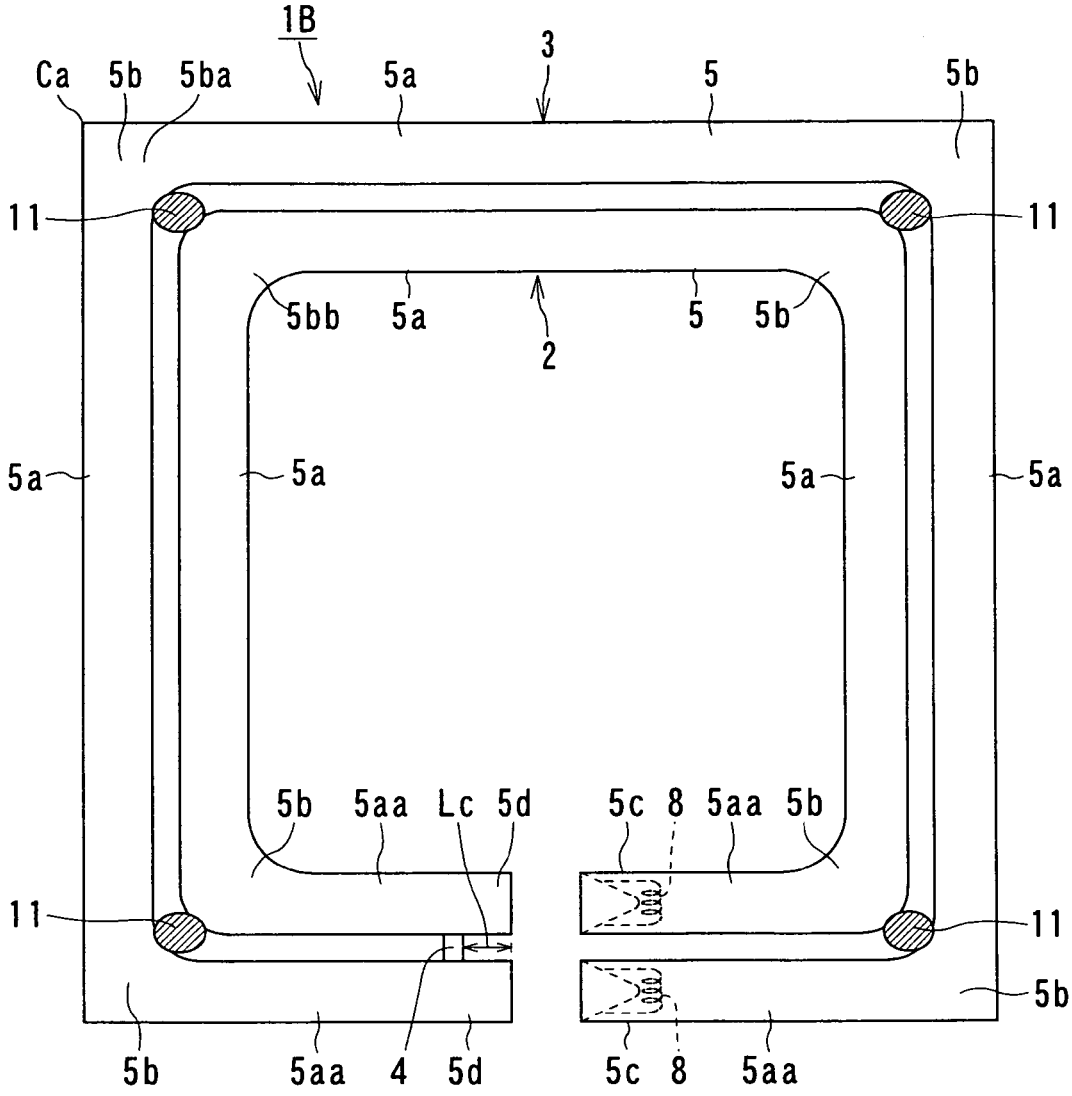
FIG. 3 is a front view of a fluorescent lamp according to a third embodiment of the present invention.

FIG. 3 is a front view of the fluorescent lamp 1B according to the third embodiment of the present invention. The fluorescent lamp 1B is characterized in that, in the above-described fluorescent lamp 1, the inner and outer bulbs 2 and 3 are connected to each other through supporting members 11, which are placed in respective spaces between the bent portions 5*b* of the inner bulb 2 and the corresponding bent portions 5*b* of the outer bulb 3, in the form of, for example, a cushioning member which has a desired shape such as an elliptic shape in its front view and a heat radiating property and elasticity, and that the length "Lc" of the connection portion-side end portion 5*d* between the outer end of the connection portion 4 (i.e., the right-hand end surface in FIG. 3) provided on the inner and outer bulbs 2 and 3 and the end surface of the connection portion-side end portion is set to be 11 mm or less. The remaining structural features are identical to those of the second embodiment as shown in FIG. 2.

The supporting member 11, which is an adhesive agent thermally conductive to the extent that heat radiation effect can be provided and made of, for example, silicone resin, connects the outer surface of each of the bent portions 5*b* of the inner glass bulb 2 to the inner surface of each of the bent portions 5*b* of the outer glass bulb 3 to hold them together into a united body and elastically supports these bulbs by the action of its elasticity. Accordingly, the strength of the inner and outer bulbs 2 and 3 made of glass can be enhanced.

Firm connection of the inner and outer bulbs 2 and 3 into the united body enables a person to handle these inner and outer bulbs 2 and 3, thus permitting an easy operation of mounting bulbs to the lighting apparatus. In addition, each of the supporting members 11 has the heat radiating property, thus permitting generation of the cold spot "ca" in the bent portion 5*ba*, which is furthest apart from the electrode 8 of the outer bulb 3.

Because of the above-reason, it is not necessary to generate the cold spot in the both of the non-luminous connection portion-side end portions 5*d*, 5*d*. In addition, the end portions 5*d*, 5*d* have no grooves for a bulb chuck (by which the bulb is grasped) in the different manner from the conventional double-circular fluorescent lamp and are closed hermetically by means of fusion cutting, thus permitting a decreased length "Lc" of the connection portion-side end portion 5*d*. Therefore, the decreased length of the connection portion-side end portion 5*d*, which is non-luminous, makes it possible to reduce the dark area and expand the luminescent area accordingly, thus enhancing the total luminous flux.

Figure 4:
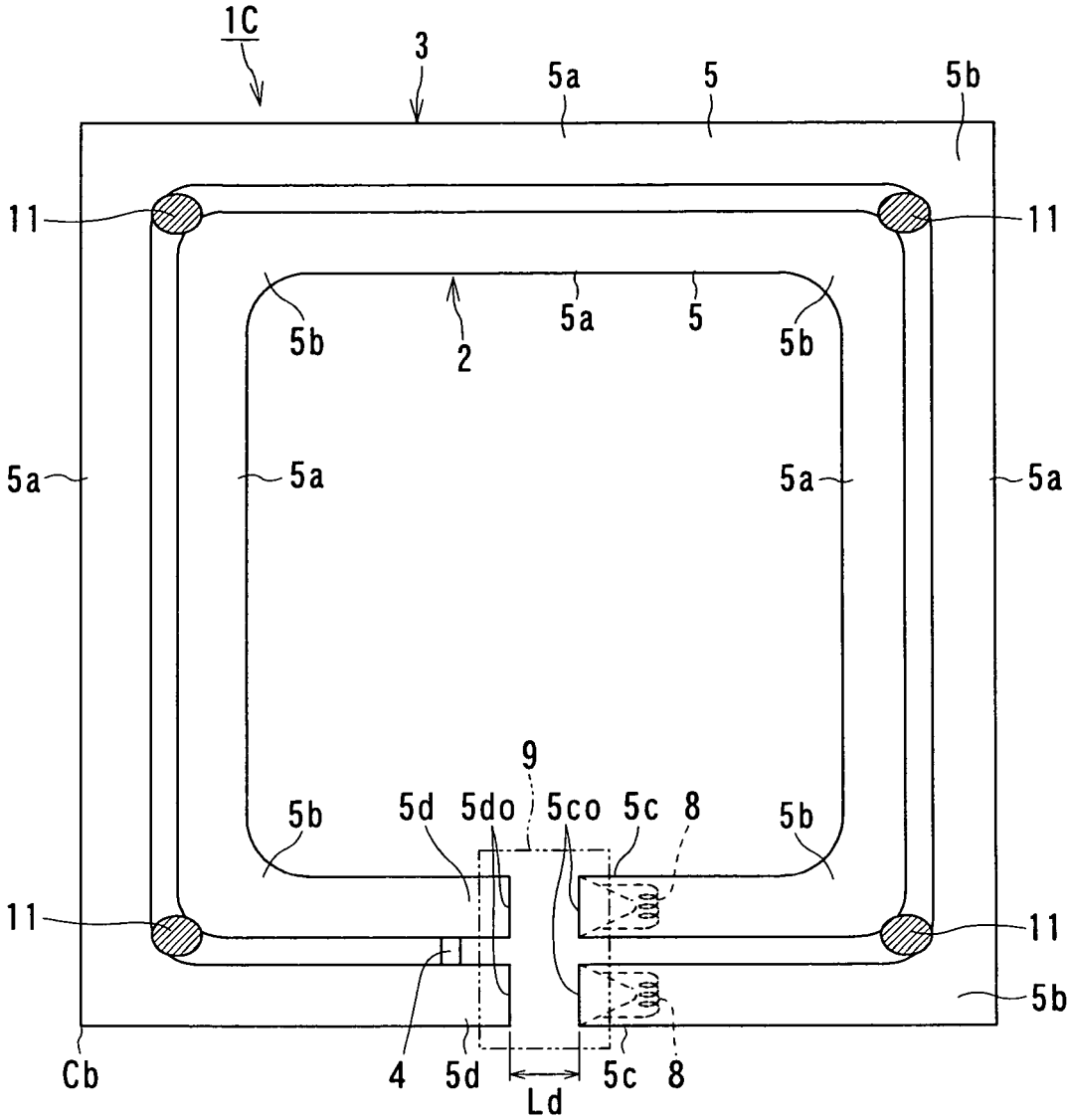
FIG. 4 is a front view of a fluorescent lamp according to a fourth embodiment of the present invention.

FIG. 4 is a front view of the fluorescent lamp 1C according to the fourth embodiment of the present invention. The fluorescent lamp 1C is characterized in that the gap "Ld" between the outer end surface 5*co* of the electrode-sealed end portion 5*c* in the axial direction thereof and the outer end surface 5*do* of the connection portion-side end portion 5*d* in the axial direction thereof is decreased, in the above-described fluorescent lamp 1B. The remaining structural features are identical to those of the fluorescent lamp 1B as shown in FIG. 3.

Figure 21:
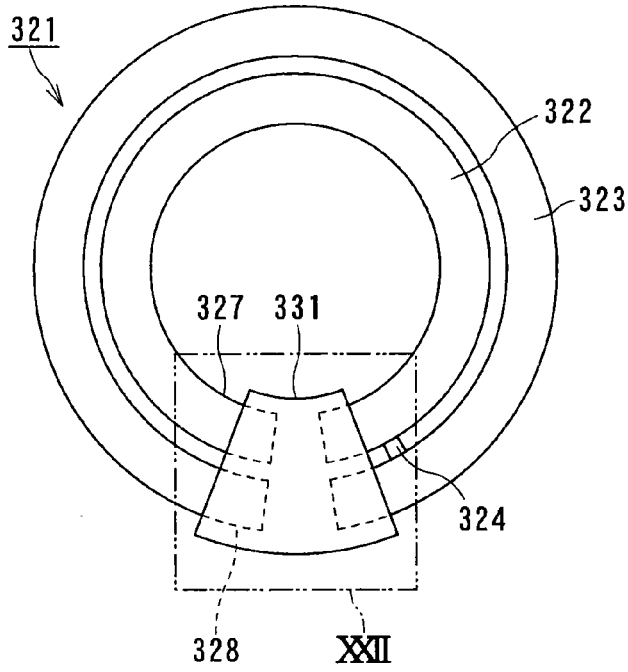
FIG. 21 Background Art
FIG. 21 is a front view of a conventional double-circular fluorescent lamp.
Figure 22:
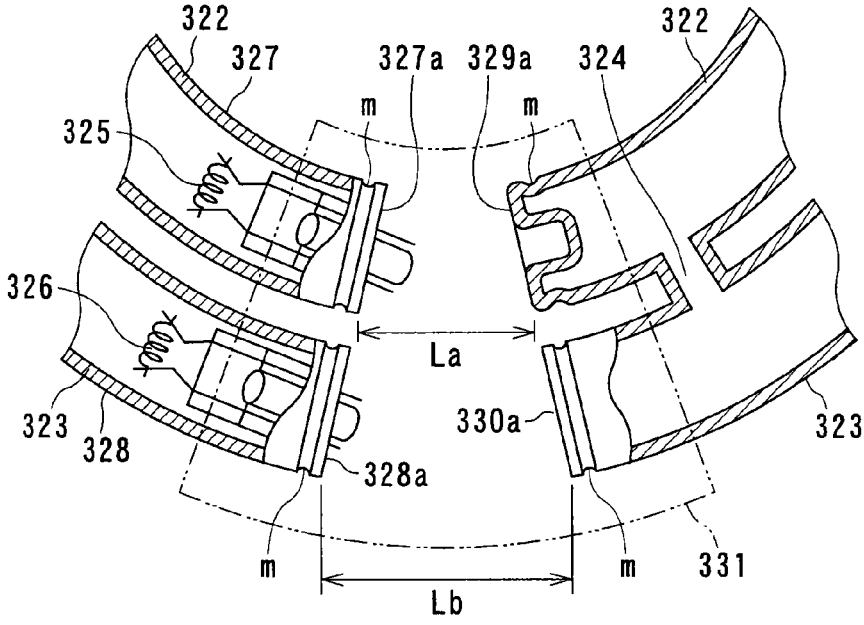
FIG. 22 is an enlarged view of a region of XXII as shown in FIG. 21.

More specifically, in the conventional double-circular fluorescent lamp 321 as shown in FIG. 21, the electrode-sealed end portions 327 and 328 and the end portions on the side of the connection portion 324 are curved as mentioned above, with the result that gaps "La" and "Lb" on the inner peripheral side and the outer peripheral side between the end surfaces 327*a* and 328*a* of the electrode-sealed end portions 327 and 328 and the opposing outer end surfaces 329*a* and 330*a* on the side of the connection portion 324 expand in a trapezoidal shape, and there is limitation in reduction of the gaps.

To the contrary, in the embodiment as shown in FIG. 4, both of the inner and outer electrode-sealed end portions 5*c*, 5*c* and both of the connection portion-side end portions 5*d*, 5*d* are straight and not curved, with the result that both the outer end surfaces 5*co*, 5*co* of the electrode-sealed end portions 5*c*, 5*c* can be placed on the same plane, and namely, so as to be substantially flush with each other, and both the outer end surfaces 5*do*, 5*do* of the connection portion-side end portions 5*d*, 5*d* can also be placed on the same plane, and namely, so as to be substantially flush with each other.

It is therefore possible to make the inner and outer gaps "Ld" substantially equal to each other between both the outer end surfaces 5*co*, 5*co* of the inner and outer electrode-sealed end portions 5*c*, 5*c* and both the outer end surfaces 5*do*, 5*do* of the connection portion-side end portions 5*d*, 5*d*, thus permitting reduction of the above-mentioned gaps "Ld".

This makes it possible to place the inner and outer electrode-sealed end portions 5*c*, 5*c* and the connection portion-side end portions 5*d*, 5*d* in the non-luminous areas, so as to be close to each other by the reduced length of the inner and outer gaps "Ld". Accordingly, the dark areas can be reduced by an approaching length of the end portions, and the luminescent areas can be expanded, thus enhancing the luminous efficiency.

Figure 5:
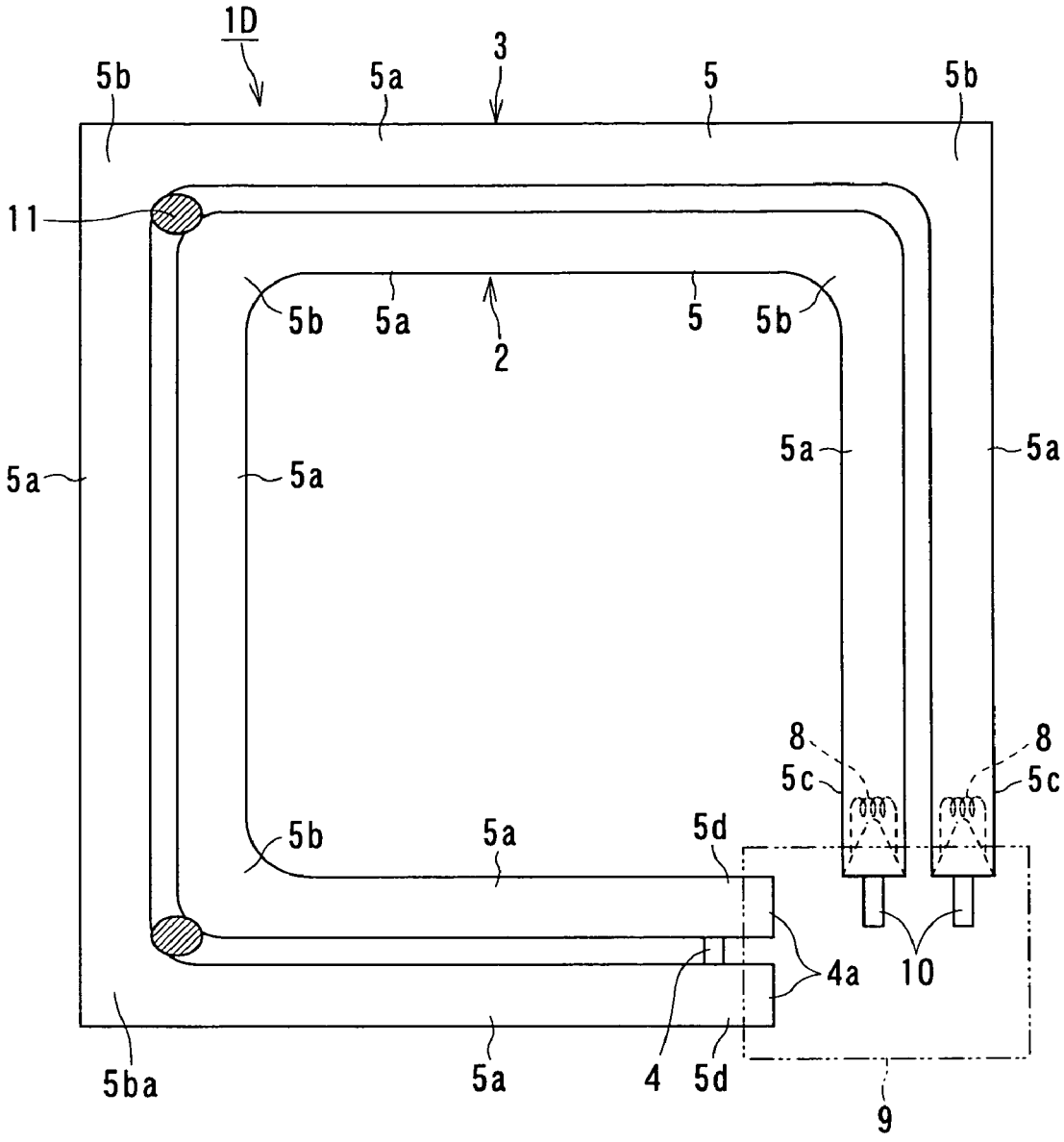
FIG. 5 is a front view of a fluorescent lamp according to a fifth embodiment of the present invention.

FIG. 5 is a front view of the fluorescent lamp 1D according to the fifth embodiment of the present invention. The fluorescent lamp 1D is characterized in that, in the above-described fluorescent lamp 1 according to the first embodiment as shown in FIG. 1, the inner and outer bulbs 2, 3 are connected, at the inner and outer bent portions 5*b*, 5*b* thereof which are placed in opposite to the base 9 in the diagonal direction, to each other through the above-described supporting member 11 in the form of a united body and these bulbs are elastically supported to each other. The sealed portions formed by means of fusion cutting on the connection portion-side end portions 5*d*, 5*d* have a hemispherical shape. The remaining structural features are identical to those of the first embodiment.

According to the fluorescent lamp 1D, the base 9 is mounted on both the electrode-sealed end portions 5*c*, 5*c* of the inner and outer bulbs 2 and 3 and the connection portion-side end portions 5*d*, 5*d* so as to straddle a region among these end portions, to provide a united body, thus increasing the strength of the inner and outer bulbs 2 and 3. In addition, the inner and outer bent portions 5*b*, 5*b* placed on the side opposite to the base 9 in the diagonal direction are connected to each other through the supporting member 11 and these portions are elastically supported to each other, thus increasing the strength of the inner and outer bulbs 2 and 3.

In addition, only one supporting member 11, which is to be provided on the bent portions 5*b* of the inner and outer bulbs 2 and 3, suffices, thus permitting reduction of material used for the supporting member 11 and its cost, as well as an easy fitting operation. The supporting member 11 may be provided between the straight tube portions 5*a*, 5*a*.

Figure 6:
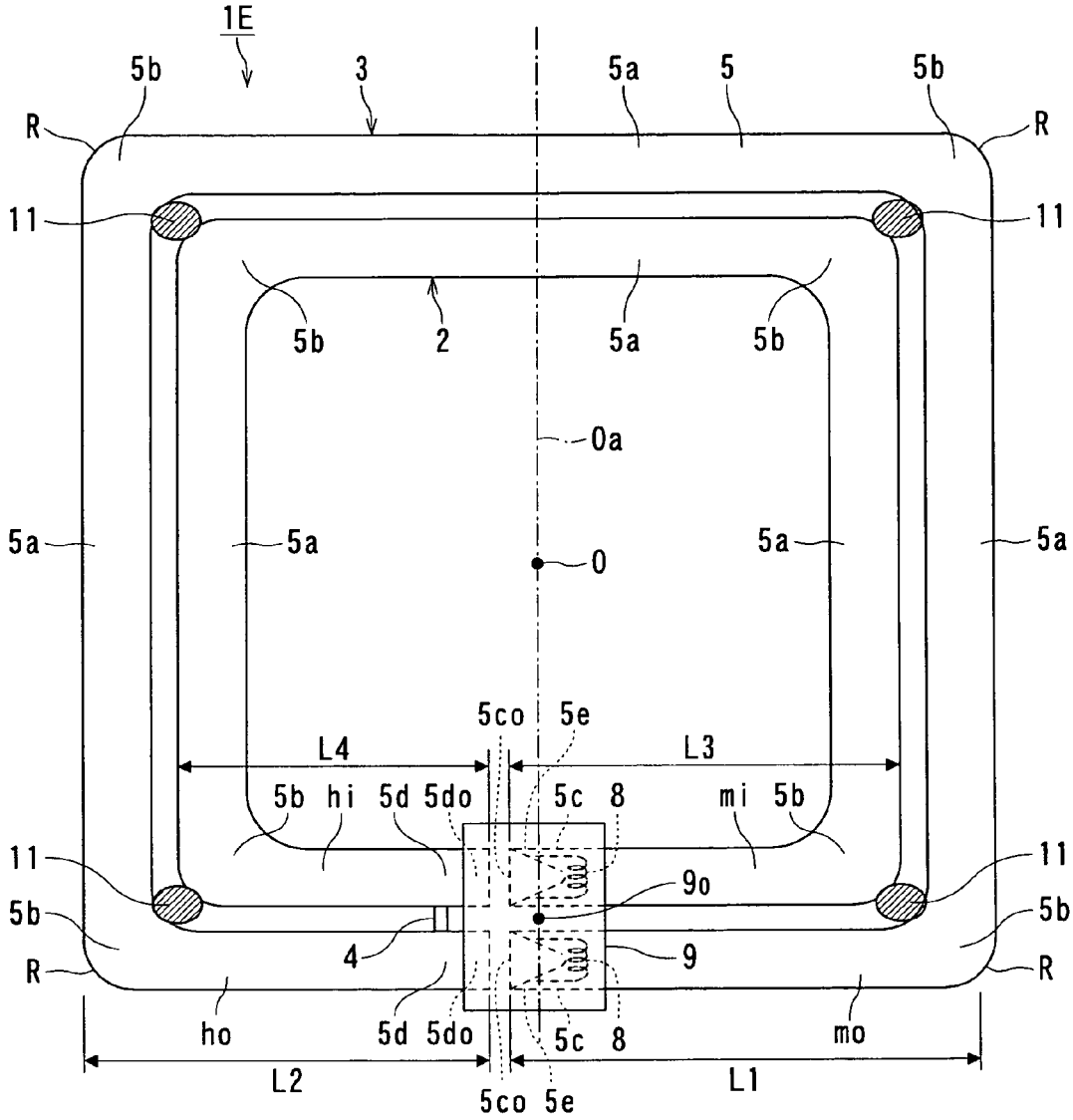
FIG. 6 is a front view of a fluorescent lamp according to a sixth embodiment of the present invention.

FIG. 6 is a front view of the fluorescent lamp 1E according to the sixth embodiment of the present invention. The fluorescent lamp 1E is characterized in that, in the above-described fluorescent lamp 1C according to the fourth embodiment as shown in FIG. 4, the electrode-sealed end portions 5*c*, 5*c* are extended linearly toward the respective connection portion-side end portions 5*d*, 5*d* to form extended portions 5*e*, 5*e* so that the pair of electrodes 8, 8 is placed in the base 9 so as to be concealed by it. Each of the bent portions 5*b* of the outer bulb 3 at the corners thereof has an arc shape "R". The remaining structural features are identical to those of the fluorescent lamp 1C according to the fourth embodiment.

More specifically, the lengths of the inner and outer bulbs 2, 3 of the fluorescent lamp 1E are determined so as to satisfy the following expression (1):

L1>L2, and

L3>L4, wherein,

L1: the outside length of the right-hand side "mo", as shown in FIG. 6, of one side of the outer bulb 3, having the electrode 8, L2: the outside length of the left-hand side "ho", as shown in FIG. 6, of one side of the outer bulb 3, having the connection portion 4, L3: the outside length of the right-hand side "mi", as shown in FIG. 6, of one side of the inner bulb 2, having the electrode 8, L4: the outside length of the left-hand side "hi", as shown in FIG. 6, of one side of the inner bulb 2, having the connection portion 4, to form the extended portions 5*e*, 5*e* of the pair of electrode-sealed end portions 5*c*, 5*c*, thus placing the pair of electrodes 8, 8 in the base 9 to conceal them therein.

According to the fluorescent lamp 1E of the present invention, the total length of the outer bulb 3 is extended by the length of the extended portion 5*e*, thus making it possible to increase the length of the discharge path. The fluorescent lamp 1E can therefore achieve an enhanced luminosity.

In addition, the pair of electrodes 8, 8 are placed in the base 9 to conceal them therein, thus making it possible to conceal shade of these electrodes in the base 9. Therefore, the fluorescent lamp 1E can achieve the further enhanced luminosity and an improved external appearance.

The respective lengths L1, L3 of the right-hand sides "mo", "mi" of the respective one sides of the inner and outer bulbs 2, 3, having the base 9 (i.e., the bottom side of the square shape in FIG. 6), as well as the respective lengths L2, L4 of the corresponding left-hand sides "ho", "hi" are determined so as to satisfy the above-mentioned expression (1), thus making it possible to place the center 9*o* of the base 9 in its transverse direction (i.e., the horizontal direction in FIG. 6) on the central line Oa passing through the center "O" of the square shape.

Accordingly, the balance between the left and right-hand sides in weight relative to the central line Oa can be kept, thus making it possible to improve an easy handling performance when the fluorescent lamp 1E is mounted on a lighting apparatus, not show, and further improve the external appearance.

Figure 7:
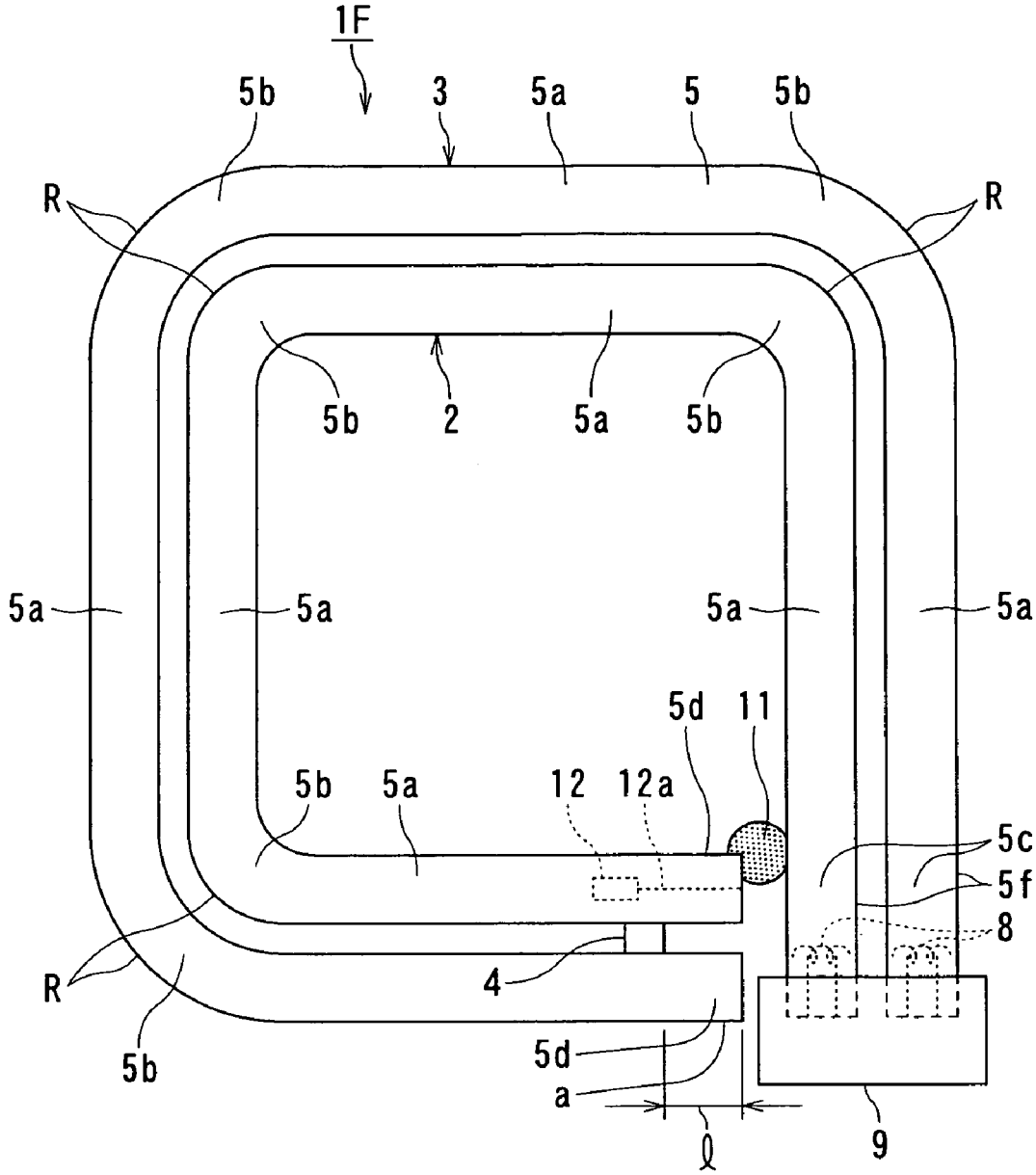
FIG. 7 is a front view of a fluorescent lamp according to a seventh embodiment of the present invention.

FIG. 7 is a front view of the fluorescent lamp 1F according to the seventh embodiment of the present invention. The fluorescent lamp 1F is characterized in that extended portions 5*f*, 5*f*, amalgam 12 and a supporting member 11 are provided in addition to the fluorescent lamp 1 shown in FIG. 1.

The extended portions 5*f*, 5*f* are formed by extending linearly the pair of electrode-sealed end portions 5*c*, 5*c* of the inner and outer bulbs 2, 3 so as to place their outer end surfaces in the respective axial lines thereof onto an extended line from the outer surface "a" (i.e., the bottom surface in FIG. 7) of the connection portion-side end portion 5*d* of the outer bulb 3, or in the vicinity of the above-mentioned extended line.

The amalgam 12, which is a metallic layer formed of indium (In) or gold (Au) on a substrate made of stainless steel and apt to adsorb mercury, is disposed in the connection portion-side end portion 5*d* of the inner bulb 2, which is located in the vicinity of the connection portion 4. The amalgam 12 is supported by means of supporting line 12*a* at its one end and the other end of the supporting line 12*a* is connected to the inner surface of the connection portion-side end portion 5*d* in a sealed manner. The amalgam may be mounted by means of flare stem, not shown. In comparison with a common case in which such a kind of fluorescent lamp 1F has a small tube diameter, resulting in a low diffusion velocity of mercury in the tube and leading to a possible problem of a lower build-up performance of the luminous flux, the amalgam 12 disposed approximately in the intermediate portion of the discharge path releases mercury immediately after the illumination, thus achieving the improvement in the build-up performance of the luminous flux.

The supporting member 11, which is an adhesive agent made of silicone resin in the same manner as that for the supporting member 11 shown in FIG. 3, is disposed between the outer surface of the connection portion-side end portion 5*d* of the inner bulb 2 and the adjacent outer surface of the electrode-sealed end portion 5*c* of the inner bulb 2 to elastically connect them to each other so as to provide a heat radiation function. This increases the mechanical strength of the inner bulb 2, thus leading to increase in mechanical strength of the whole fluorescent lamp 1F. In addition, each of the bent portions 5*b* of the inner and outer bulbs 2, 3 at their outside surfaces thereof have an arc shape "R".

The symbol "l", which denotes the minimum length between the connection portion 4 and the outer surfaces of the pair of connection portion-side end portions 5*d*, 5*d*, is 8 mm in the embodiment of the present invention. This length "l" should just be 15 mm or less (within the range of from 0 to 15 mm). It is preferably within the range of from 0 to 10 mm, but may be within the range of from 2 to 10 mm.

Figure 8:
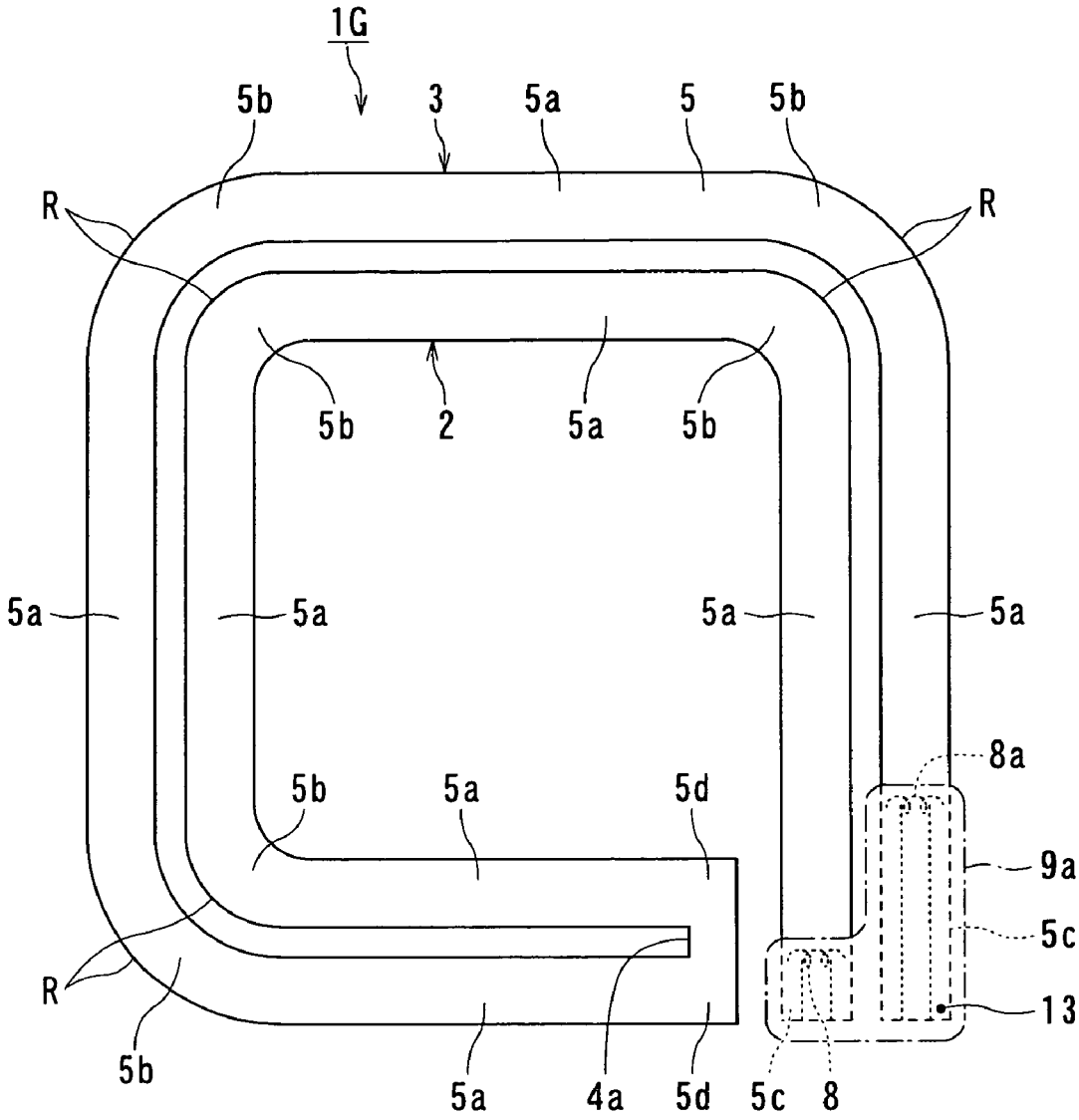
FIG. 8 is a front view of a fluorescent lamp according to a eighth embodiment of the present invention.

FIG. 8 is a front view of the fluorescent lamp 1G according to the eighth embodiment of the present invention. The fluorescent lamp 1G is characterized in that, in the fluorescent lamp 1F shown in FIG. 7, the amalgam 12, its supporting line 12*a* and the supporting member 11 are omitted, and the connection portion 4 is provided in the form of a U-shaped connection portion 4*a*, the electrode 8 of the outer bulb 3 is structured as a so-called high-mount type electrode 8*a*, which is placed in a higher position than the electrode 8 of the inner bulb 2, and the base 9*a* is provided so as to entirely conceal the electrodes 8, 8*a*.

The U-shaped connection portion 4*a* is formed into a U-shape structure integrally with the inner and outer bulbs 2 and 3 by carrying out, for example, a molding process, to the connection portion-side end portions 5*d*, 5*d* of the inner and outer bulbs 2 and 3. The length "l" between the outer end (i.e., the right-hand end in FIG. 7) of the connection portion 4 and the outer surfaces of the pair of connection portion-side end portions 5*d*, 5*d* is set to "zero" so as to provide a flat surface.

As a result, the discharge path can be formed also in the U-shaped connection portion 4*a* so that the U-shaped connection portion 4*a* is also illuminated, thus enhancing the luminous efficiency. The flat surface of the U-shaped connection portion 4*a* at the outer end in its axial direction does not cause any problem in the process of forming the inner and outer bulbs 2 and 3 into the square shape, since there is no need to grasp the outer surface of the U-shaped connection portion 4*a* with the use of a chuck to form the respective bent portions 5*b* of the inner and outer bulb 2 and 3.

The electrode of the outer bulb 3 is structured as the high-mount type electrode 8*a*, thus enabling the cold spot 13 to be generated at a outer corner on the bottom surface of the electrode end 5*c* of the outer bulb 3, which is placed in a position lower than the high-mount type electrode 8*a* in FIG. 8.

Since the above-mentioned cold spot 13 is surrounded with the base 9*a*, it becomes possible to improve the stability of temperature, in comparison with the case in which the cold spot is generated at the lower corner of the U-shaped connection portion 4*a* in FIG. 8. More specifically, the cold spot is exposed directly to an ambient air in the latter case, thus providing a lower stability in temperature. When the temperature in the base 9*a* is relatively high and the temperature of the cold spot is also higher than a standard value, ventilating holes may be formed in the base 9*a* for ventilating the ambient air.

In addition, the electrode of the outer bulb 3 is structured as the high-mount type electrode 8*a*, resulting in a visual recognition as if the luminous area located above the high-mount type electrode 8*a* in FIG. 8, is combined together with the luminous area located above the electrode 8 of the inner bulb 3 and the adjacent luminous area of the U-shaped connection portion 4*a* so as to be continuously connected in the form of arc, thus improving external appearance.

Figure 9:
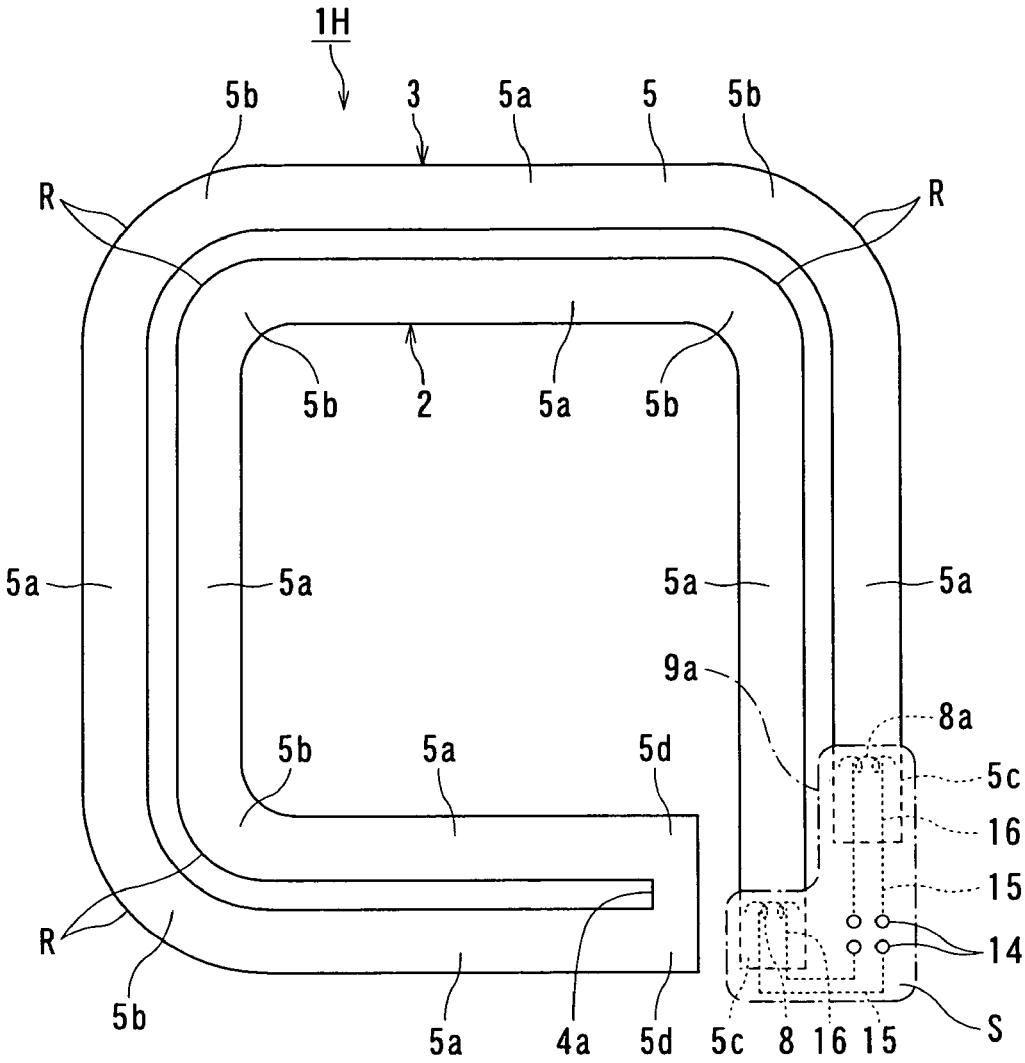
FIG. 9 is a front view of a fluorescent lamp according to a ninth embodiment of the present invention.

FIG. 9 is a front view of the fluorescent lamp 1H according to the ninth embodiment of the present invention. The fluorescent lamp 1H is characterized in that, in the fluorescent lamp 1G shown in FIG. 9, the base 9*a* has a space "S" formed therein, the high-mount type electrode 8*a* of the outer bulb 3 is changed to the same type as the electrode 8 of the inner bulb 2, which is not a high-mount type, and four base pins 14, 14, 14, 14 serving as electricity receiving members are provided on the outer surface of the base 9*a* above the space "S".

More specifically, the space "S" in the base 9*a* is formed, by shortening the electrode-sealed end portion 5*c* of the outer bulb 3 relative to the electrode-sealed end portions 5*c* of the inner bulb 2, so as to be placed outside the electrode-sealed end portions 5*c* of the outer bulb 3 in the axial direction thereof.

The base 9*a* located above the space "S" is provided on its outer surface with, for example, four base pins 14. Each of the base pins 14 passes through the base 9*a* from the outer surface thereof to the inner surface thereof. The inner ends of these pins are connected to inner lead wires 16 of the electrodes 8, 8 through outer lead wires. The base 9*a* is formed of resin, for example, into a hollow prism shape through a molding formation process. The base is composed of at least two divided sections, which correspond to the front and back surfaces of a sheet of paper of FIG. 9.

According to the fluorescent lamp 1H of the present invention, the four outer lead wires 15 can be connected to the respective inner ends of the four base pins 14 in the space "S" within the base 9*a* so as to ensure a space for routing appropriately the outer lead wires 15. It is therefore possible to improve easiness of connecting and wiring operation and prevent interference between these outer lead wires 15, respectively.

Figure 10:
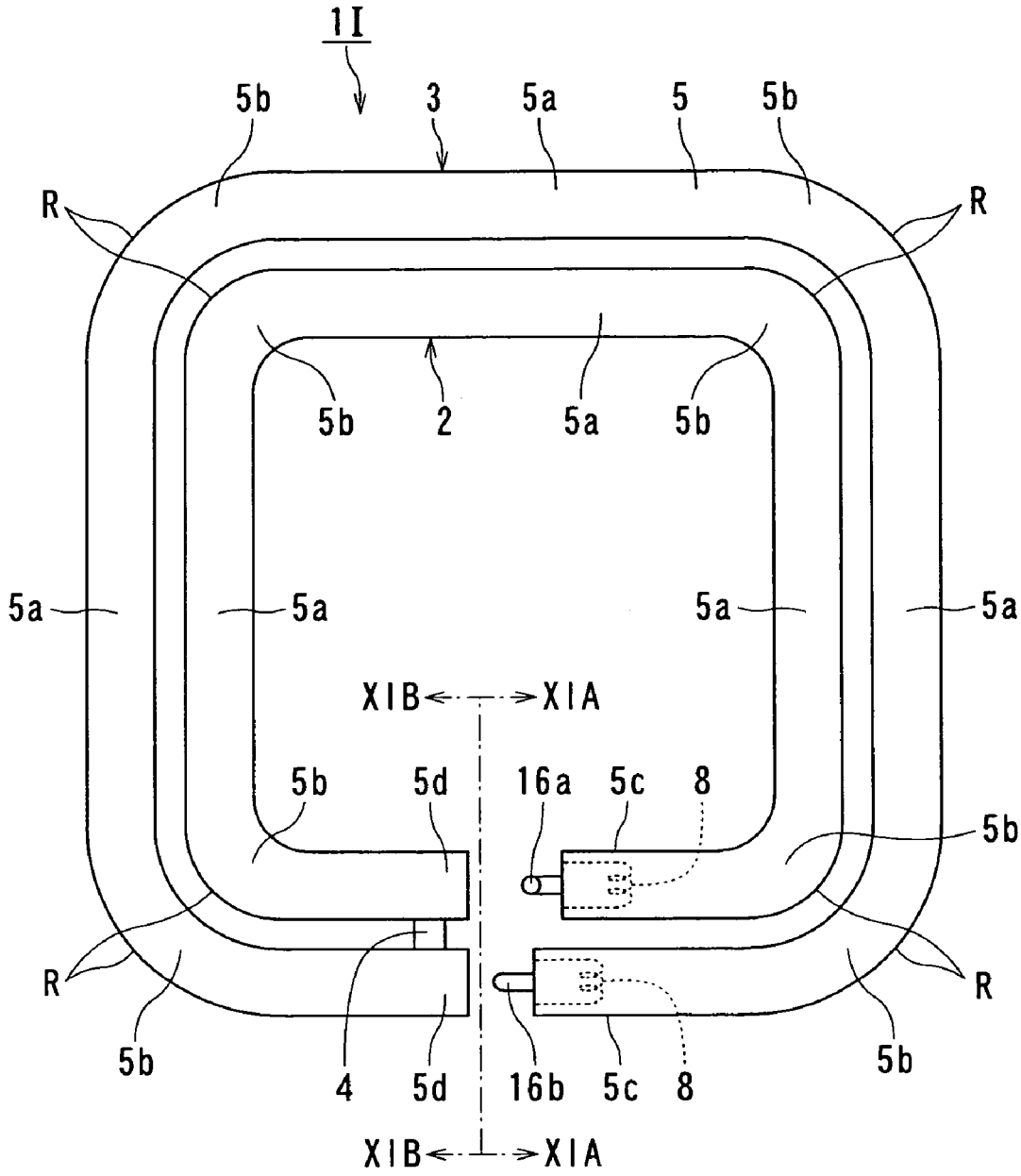
FIG. 10 is a front view of a fluorescent lamp according to a tenth embodiment of the present invention.
Figure 11:
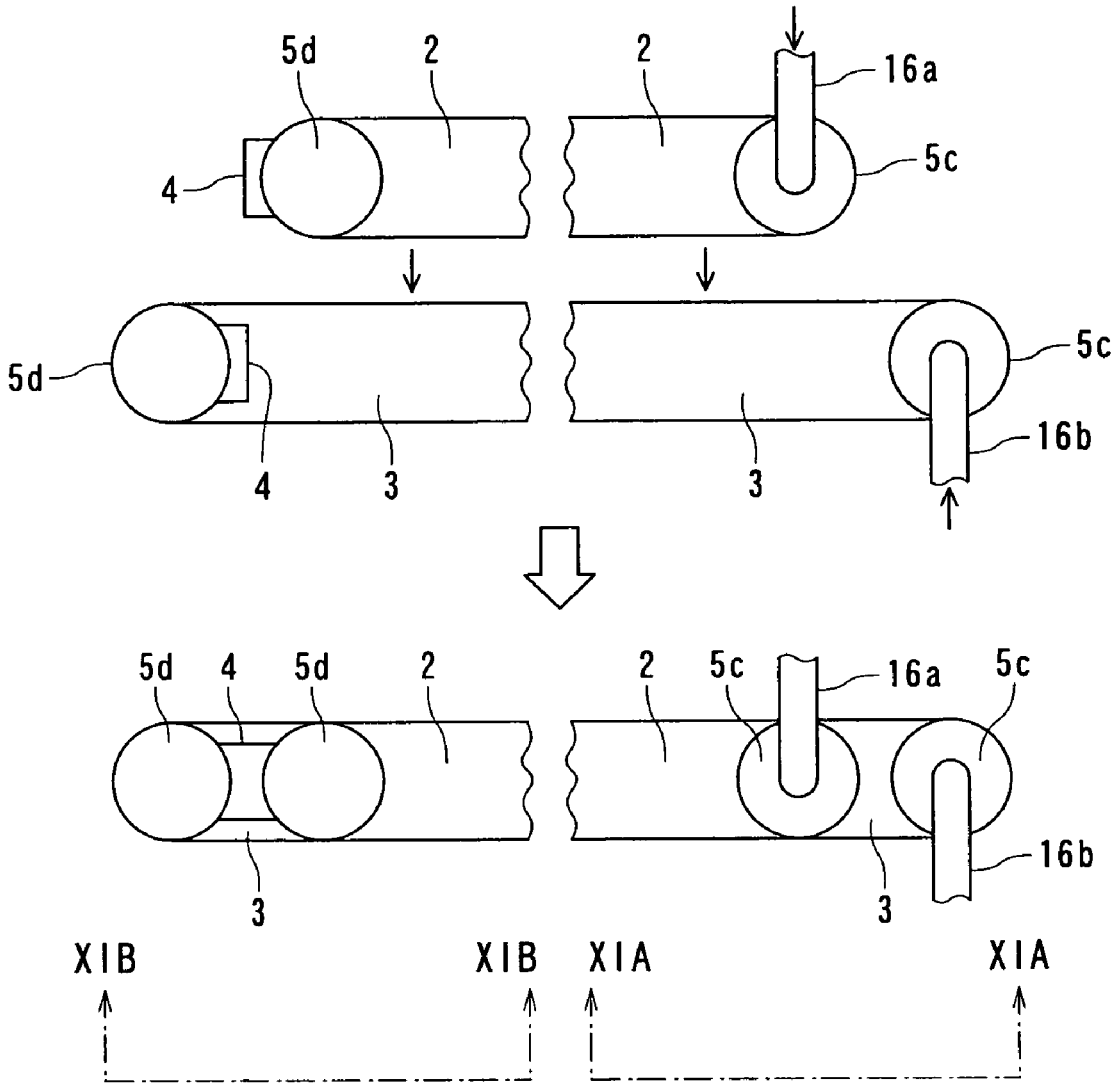
FIG. 11 is a view along the viewing line XIA-XIA and the viewing line XIB-XIB.

FIG. 10 is a front view of the fluorescent lamp 1I according to the tenth embodiment of the present invention. FIG. 11 provides, at its upper section, a partial end view of the inner and outer bulbs 2, 3, in which the connection portions 4 thereof have not yet been connected to each other, and also provides, at its lower section, a partial end view of the inner and outer bulbs 2, 3, in which the connection portions 4 thereof have already been connected to each other. The end view on the right-hand side in FIG. 11 provides a view based on the viewing line XIA-XIA in FIG. 10 and the end view on the right-hand side in FIG. 11, a view based on the viewing line XIB-XIB in FIG. 10. The fluorescent lamp 11 is characterized in that, in the fluorescent lamp 1A shown in FIG. 2, there is improved a pair of discharge pipes 16*a*, 16*b* of the respective inner and outer bulbs 2, 3, each of which is formed of an L-shaped glass pipe, not shown.

More specifically, one of the inner and outer bulbs 2, 3, for example, the inner bulb 2, is slightly shortened so that the outer end surface of the electrode-sealed end portion 5*c* of the inner bulb 2 is slightly shifted outwardly (i.e., toward the right-hand side in FIG. 10) from the outer end surface of the electrode-sealed end portion 5*c* of the outer bulb 3. A pair of discharge pipes 16*a*, 16*a* are provided on the respective outer surfaces of the electrode-sealed end portions 5*c*, 5*c* of the inner and outer bulbs 2 and 3 so as to project outward in the axial direction thereof. The discharge pipes, which communicate with the respective insides of the inner and outer bulbs 2 and 3, are connected at their outer opening ends to a head of a supplying and discharging unit, not shown, so as to discharge the air from the inner and outer bulbs 2, 3 and to supply rare gas such as argon and mercury therein.

As shown in FIG. 11, one of the paired discharge pipes 16*a*, 16*b*, for example, the discharge pipe 16*a*, projects slightly outward from the outer end surface of the electrode-sealed end portion 5*c* of the inner bulb 2 so as to be concentric therewith in the axial direction (i.e. the horizontal direction), curves in the form of arc and then extends upward in the perpendicular direction to the axial direction (i.e., the vertical direction).

To the contrary, the other discharge pipe 16*b* projects slightly outward from the outer end surface of the electrode-sealed end portion 5*c* of the outer bulb 3 so as to be concentric therewith in the axial direction (i.e. the horizontal direction), curves in the form of arc and then extends downward in the perpendicular direction to the axial direction (i.e., the vertical direction).

The paired discharge pipes 16*a*, 16*b* face in the opposite directions to each other (i.e., the upward and downward directions) in the perpendicular direction to the axial direction of the inner and outer bulbs 2 and 3. Even when the pair of discharge pipes 16*a*, 16*b* are placed close to each other, it is possible to connect easily and rapidly the above-mentioned discharging and supplying head to the outer opening end of the other discharge pipe, e.g., the pipe 16*a* in a reliable manner, without interruption or hindrance by one of them (for example, the pipe 16*b*).

In the case where a pair of discharging and supplying heads are provided, it is possible to connect substantially simultaneously these heads to the discharge pipes 16*a*, 16*a* so as to conduct a discharging and supplying operation, thus permitting an improved operational efficiency of the discharging and supplying process.

Upon connection of the connection portions 4 of the inner and outer bulbs 2 and 3 as shown in FIG. 11, the portions, on which the connection portions 4 are to be formed, of the paired upper and lower connection portion-side end portions 5*d*, 5*d* are heated to be softened by a flame from a burner, while blasting gas having a predetermined pressure into the bulbs from the paired upper and lower discharge pipes 16*a*, 16*b* to break, by blast, the softened portions, on which the connection portions 4 are to be formed, and fusion-connecting the tip ends as broken, which project outward. The connection portion 4 is formed in this manner, as shown in the lower and left-hand side of FIG. 11.

It is possible to connect the pair of upper and lower discharging and supplying heads to the pair of discharge pipes 16*a*, 16*b* to carry out a gas blowing process also in the case of forming the connection portion 4, thus advancing simply and rapidly the formation process of the connection portion 4 in a reliable manner and improving the operation efficiency.

The pair of discharge pipes 16*a*, 16*b* are to be cut with their cut root ends, after completion of the discharging and supplying process and the formation process of the connection portion 4. Each of the bent portions 5*b* of the inner and outer bulbs 2, 3 at the outside surfaces thereof has an arc shape "R".

Figure 12:
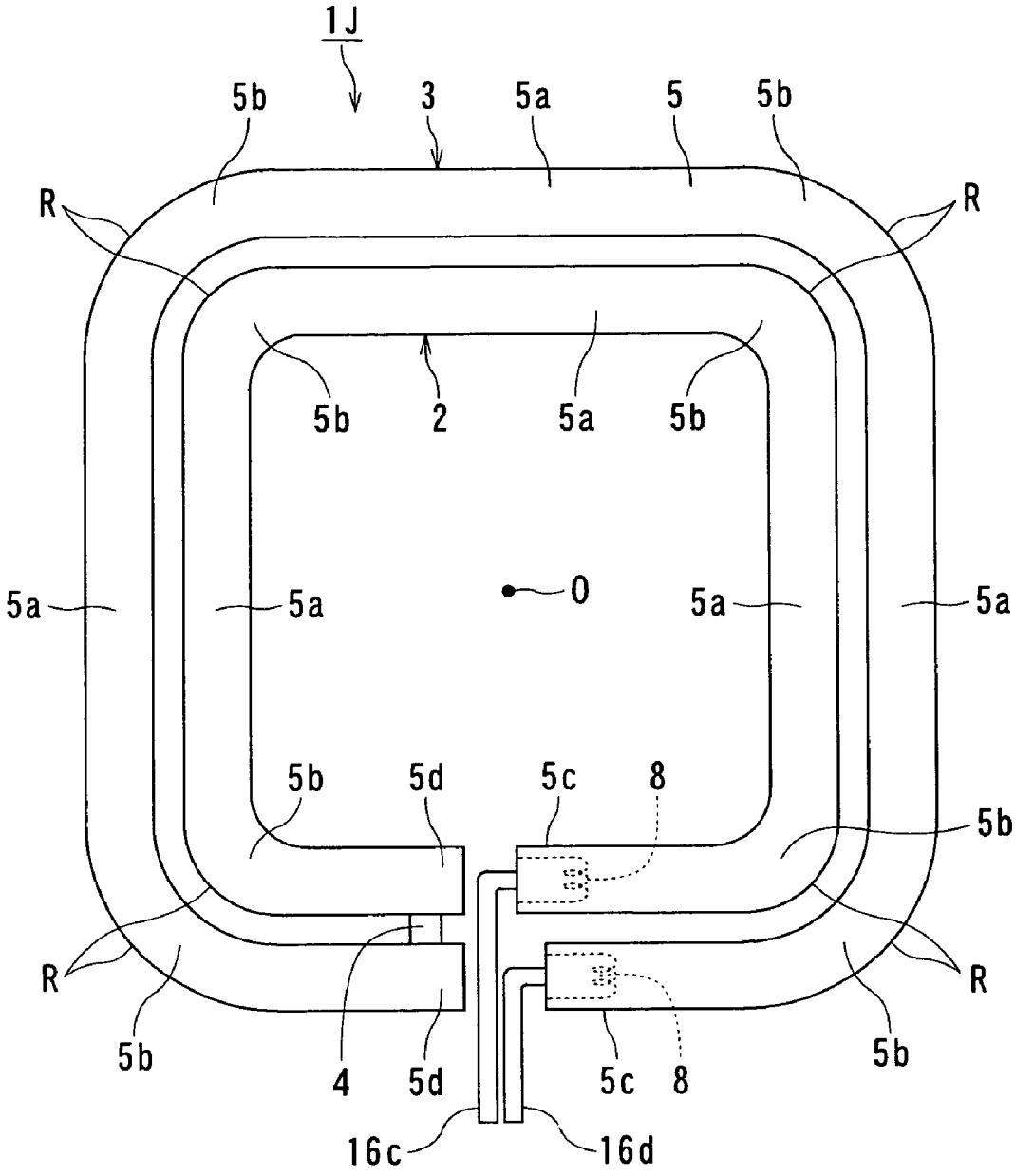
FIG. 12 is a front view of a fluorescent lamp according to a eleventh embodiment of the present invention.

FIG. 12 is a front view of the fluorescent lamp 1J according to the sixteenth embodiment of the present invention. The fluorescent lamp 1J is characterized mainly in that, in the fluorescent lamp 11 shown in FIG. 10, the length of the electrode-sealed end portion 5*c* of the outer bulb 2 is shorten relative to the length of the electrode-sealed end portion 5*c* of the inner bulb 2, and a pair of upper and lower discharge pipes 16*a*, 16*b* are substituted with a pair of inner and outer discharge outward pipes 16*a*, 16*b*, which face outward relative to the center "O" of the square shape structure. The remaining structural features are substantially similar to those of the fluorescent lamp 1I.

More specifically, the length of the side corresponding the electrode-sealed end portion 5*c* of the inner bulb 3 is shortened so that the outer end surface of the electrode-sealed end portion 5*c* of the outer bulb 3 is slightly shifted inwardly (i.e., toward the right-hand side in FIG. 12) from the outer end surface of the electrode-sealed end portion 5*c* of the inner bulb 2, so as to form a passage through which the inner discharge pipe 16*c* of the inner bulb 2 passes outside the rectangular shape.

The paired outward discharge pipes 16*c*, 16*d* slightly project outward from the outer end surfaces of the pair of inner and outer electrode-sealed end portions 5*c*, 5*c* in their axial directions (i.e., the horizontal direction), curve in the form of arc and then extend outside the fluorescent lamp 1J in parallel with each other.

Figure 13:
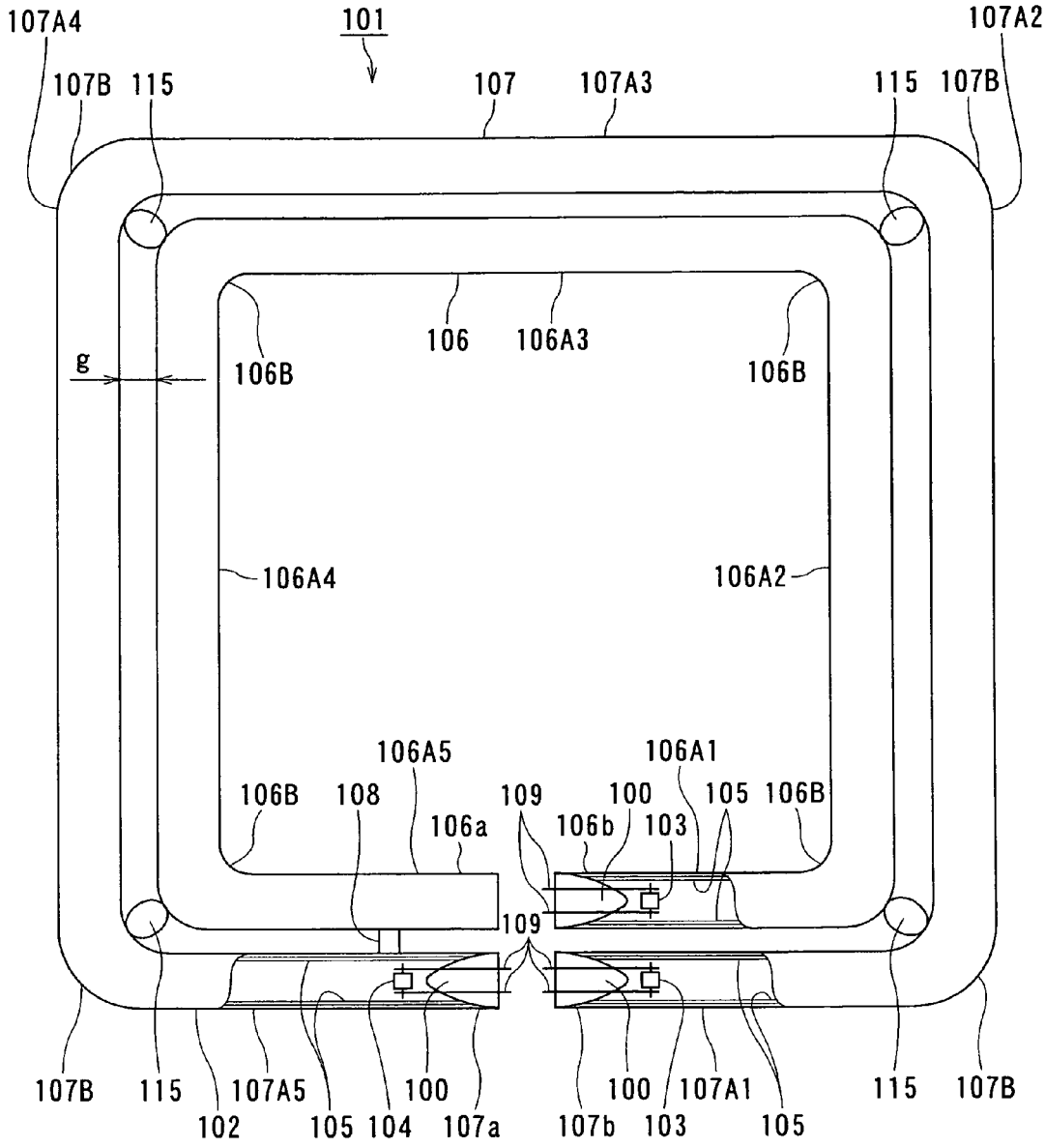
FIG. 13 is a schematic front view of a fluorescent lamp, partially cut away, according to a twelfth embodiment of the present invention.
Figure 14:
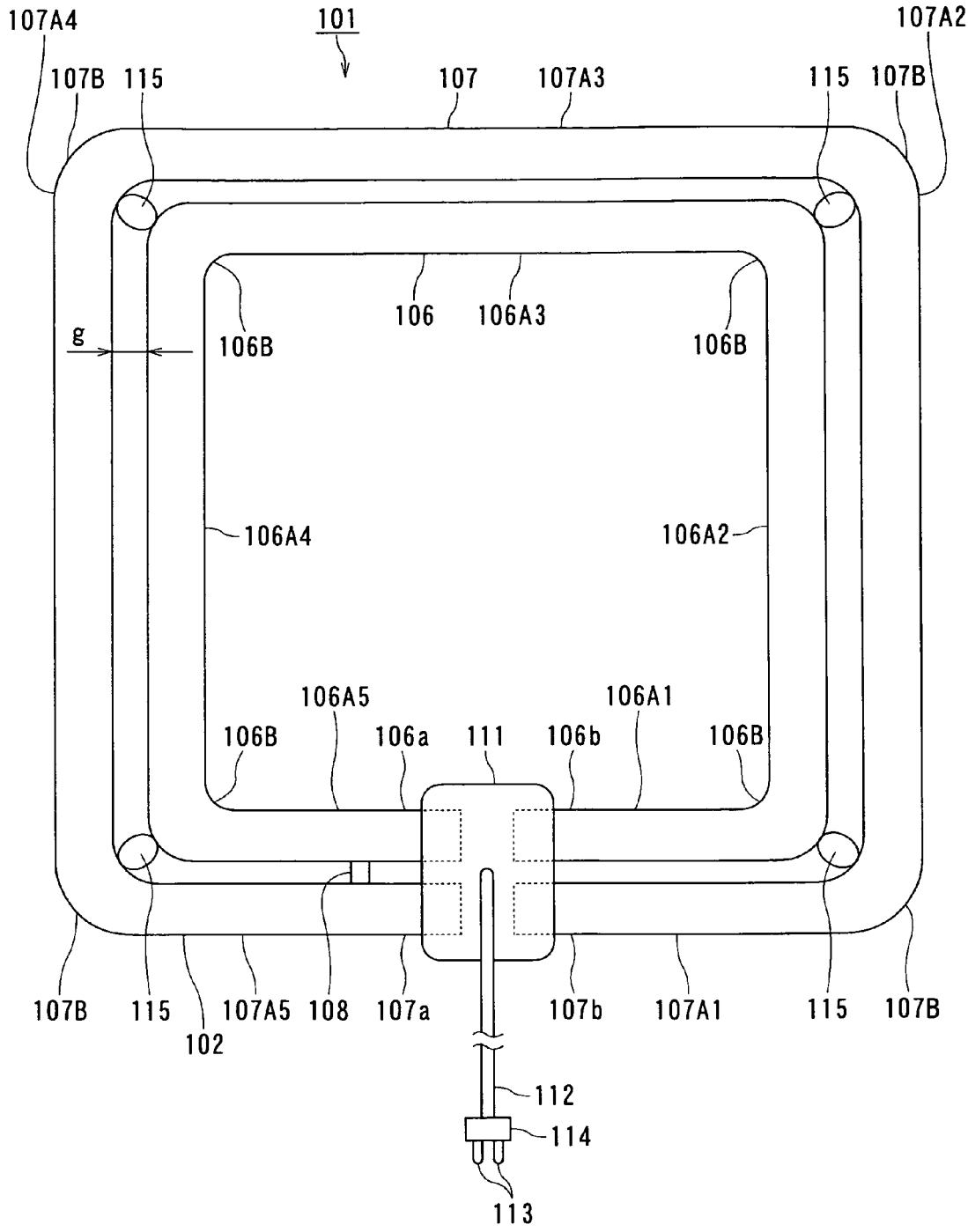
FIG. 14 is a schematic front view of a fluorescent lamp provided with a base of the present invention.
Figure 15:
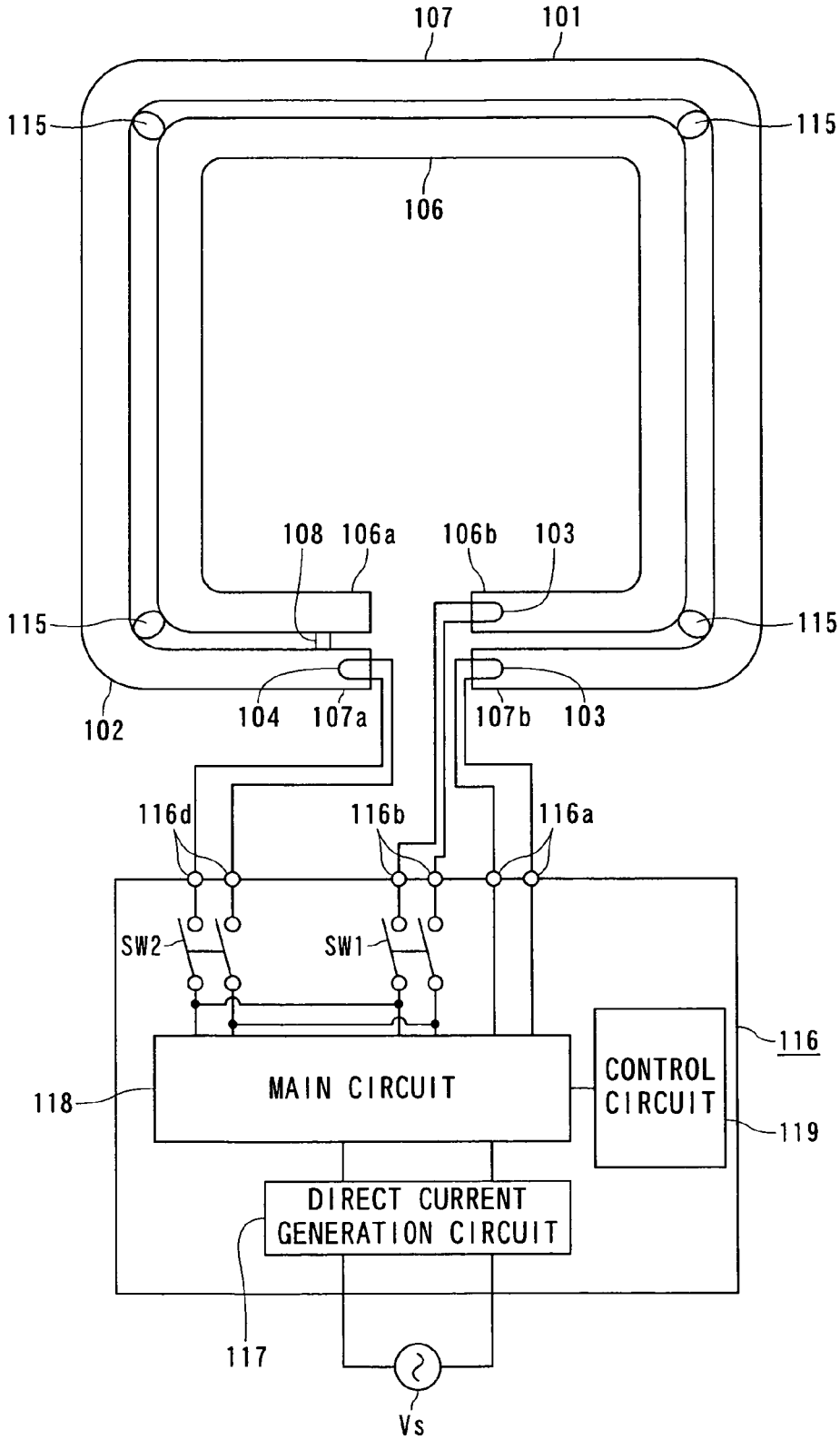
FIG. 15 is a schematic block diagram of a high frequency lighting device of the present invention.

FIGS. 13 to 15 show the fluorescent lamp 101 according to the twelfth embodiment of the present invention, and FIG. 13 is a schematic front view of the fluorescent lamp 101, partially broken away, FIG. 14 is a schematic front view of the fluorescent lamp 101 provided with a base, and FIG. 15 is a schematic block diagram of a high frequency lighting device 116.

As shown in FIG. 13, the fluorescent lamp 101 is composed of the double-circular structure glass bulb 102, which is structured in the similar manner as the second embodiment as shown in FIG. 2, a pair of first electrodes 103, 103, a second electrode 104, and a phosphor layer 105.

The glass bulb 102 is structured in the form of double-ring (double bulb) by disposing the outer bulb 107 on the outside of the inner bulb 106 on the same plane so as to be concentric with each other at a predetermined gap "g" and connecting them through the connection portion 108 to form a single discharge path.

The inner bulb 106 has five straight tube portions 106A1 to 106A5 and four bent portions 106B so that the opposite ends 106*a*, 106*b* face each other. The outer bulb 107 has five straight tube portions 107A1 to 107A5 and four bent portions 107B so that the opposite ends 107*a*, 107*b* face each other.

The first electrode 103, which is a hot cathode type filament electrode on which an emitter is applied, is placed in each of the other end portions (i.e., the end portions of the bulbs 102, which are placed on the opposite side to the connection portion 108) of the inner bulb 106 and the inner bulb 107. The second electrode 104, which has the same structure as the first electrode 103, is placed in the one end portion (i.e., the end portion of the of the outer bulb 107, on which the connection portion 108 is formed) of the outer bulb 107. The one end portion 106*a* of the inner bulb 106 is air-tightly closed by applying a fusion cutting process or attaching a sealing member such as a dummy stem. The bulb ends 106*b*, 107*b* are located at the opposite ends of the single discharge path formed in the bulb 102, respectively, and the bulb end 107*a* in which the second electrode 104 is disposed, is located at the intermediate portion of the above-mentioned discharge path.

The first electrodes 103, 103 and the second electrode 104 are filament electrodes formed of a triple coil on which emitter material has been applied. The opposite ends of each of these electrodes are supported by means of a pair of lead wires 109, 109. These lead wires 109, 109 are supported in a sealed state by means of flare stems 110, which are fitted into the other end portion 106*b* of the inner bulb 106 and the opposite end portions 107*a*, 107*b* of the outer bulb 107, so as to project outward. In the accompanying figures, the reference numeral "105" denotes a phosphor layer, which is formed on the protection layer, not shown, and includes three-band fluorescent type phosphor particles.

The base 111 having an approximately rectangular parallelepiped is attached to the respective opposite ends 106*a*, 106*b*, 107*a*, 107*b* of the inner bulb 106 and the outer bulb 107 so as to straddle a space between these ends 106*a*, 106*b*, 107*a*, 107*b*, as shown in FIG. 14. An electric cable 112 extends from the base 111, and a connector 114, which has, at its tip end, six connection pins 113, is connected to the leading end of the electric cable 112. Each of the connection pins 113 is electrically connected to the lead wires 109, 109 of the bulb 102 through the electric cable 112. The connection pins 113 may be embedded on the outer surface of the base 111, without being connected through the electric cable 112 and the connector 114.

Supporting members 115 each of which is made of silicone resin, are provided between the inner bulb 106 and the outer bulb 107.

The fluorescent lamp 101 is connected to the high frequency lighting device 116, as shown in FIG. 15. The high frequency lighting device 116 is composed of output terminals 116*a*, 116*b*, 116*c*, 116*d*, a known direct voltage generation circuit 117, a main circuit 118 and a control circuit 119. The direct voltage generation circuit 117, which includes for example a rectifier instrument and a smoothing capacitor (both of them are not shown), rectifies and smoothes alternating voltage from a commercial alternating-current power supply Vs to generate current voltage. The main circuit 118, which includes a switching element, not shown, such as a field-effect transistor, converts the current voltage outputted from the direct voltage generation circuit 117 into high frequency voltage through a switching operation of the switching element, and outputs the high frequency voltage to the output terminals 16*a* -116*d*.

Connection of the connector 114 of the fluorescent lamp 101 to the output terminals 16*a* -116*d* leads to connection of the opposite ends of the first electrode 103 at the side of the other end portion 107*b* of the outer bulb 107 to the output terminals 116*a*, 116*a*, and connection of the opposite ends of the first electrode 103 at the side of the other end portion 106*b* of the inner bulb 106 to the output terminals 116*b*, 116*b*, and connection of the opposite ends of the second electrode 104 at the side of the one end portion 107*a* of the outer bulb 107 to the output terminals 116*d*, 116*d*. In FIG. 15, the base 111, the connection pins 113 and the connector 114 as shown in FIG. 14 are omitted.

The control circuit 119 causes the switching element to carry out a switching operation at a preheating frequency, a starting frequency and a lighting frequency. As a result, a preheating voltage outputted from the main circuit 118 is applied between the respective opposite ends of output terminals 116*a*, 116*a*, the output terminals 116*b*, 116*b* and the output terminals 116*d*, 116*d* during a preheating period of the fluorescent lamp 101, and the starting voltage and the lighting voltage are applied between the output terminals 116*a*, 116*d* or the output terminals 116*a*, 116*b* when starting and lighting.

In addition, it is configured that the above-mentioned output voltage outputted from the main circuit 118 is supplied to the output terminals 116*b*, 116*b* through the switch SW1 and to the output terminals 116*d*, 116*d* through the switch SW2. More specifically, when the switch SW1 is kept in an "ON" state, the output voltage from the main circuit 118 is applied between a pair of first electrodes 103, 103 (to the primary discharge path), and when the switch SW2 is kept in an "ON" state, the output voltage from the main circuit 118 is applied between the first electrode 103 and the second electrode of the outer bulb 107 (to the secondary discharge path). The switches SW1 and SW2, which are kept in an "ON" state, enables the first electrode 103 of the outer bulb 107 to be used as a common electrode to generate output voltage in the primary discharge path and the secondary discharge path. The switch SW2, which is kept in an "OFF" state, disables the output voltage from being applied to the secondary discharge path. The control circuit 19 is configured so as to permit independent control of the ON-OFF operation of the switches SW1 and SW2.

The operation of the fluorescent lamp 101 according to the twelfth embodiment of the present invention will be described hereunder.

In order to start the lighting of the fluorescent lamp 101 for illumination with the use of the high frequency lighting device 116, the switches SW1, SW2 are kept first in an "ON" state to output the preheating voltage from the main circuit 118 so as to preheat a pair of first electrodes 103, 103 and the second electrode 104.

After the first electrodes 103, 103 and the second electrode 104 have been preheated fully, the predetermined starting voltage is applied from the main circuit 118 of the high frequency lighting device 116 between the second electrode 104 and the first electrode 103 of the outer bulb 7, and between the pair of first electrodes 103, 103 of the illumination tube 102 (i.e., between the first electrode 103 of the inner bulb 106 and the first electrode 103 of the outer bulb 107). At this time, the second electrode 104 of the outer bulb 107 and the first electrode 103 of the inner bulb 106 have the same electrical potential. The starting voltage is remarkably higher than the lamp voltage of the illumination tube 102 during the normal lighting mode.

The starting voltage is applied between the second electrode 104 of the outer bulb 107 and the first electrode 103 as well as between the first electrodes 103, 103 of the illumination tube 102 at the same voltage value, with the result that discharge is generated in the secondary discharge path (i.e., between the second electrode 104 and the first electrode 103 of the outer bulb 107), which has a smaller length than the primary discharge path of the illumination tube 102, thus providing illumination of the outer bulb 107. A not-shown detecting device may be provided to detect the illumination of the outer bulb 107. The control circuit 119 causes only the switch SW2 to be kept in an "OFF" state, at the time when the detection by the detecting device is made, or after a lapse of the predetermined period of time from the start of application of the starting voltage.

The voltage having the same electrical potential as the second electrode 104 is applied to the first electrode 103 of the inner bulb 106. Accordingly, when the switch SW2 is kept in an "OFF" state, the end of the discharge occurring in the secondary discharge path in the outer bulb 107 extends from the second electrode 104 to the first electrode 103 of the inner bulb 106, thus entering the discharge mode utilizing the primary discharge path between the first electrodes 103, 103 of the illumination tube 102. Subsequently, the fluorescent lamp 101 is illuminated at high frequency in a stable manner.

In the fluorescent lamp 101, the discharge occurs in the primary discharge path after the discharge occurs in the secondary discharge path having the shorter length of the primary discharge path, with the result that a voltage, which is comparable to the voltage required for the start of lighting of the outer bulb 10, could be applied in the form of starting voltage, thus making it possible to reduce the starting voltage for the fluorescent lamp 101, in comparison with application of the starting voltage only between the paired electrodes 103, 103 of the illumination tube 102, and permitting an easy design of circuit of the high frequency lighting device 116.

Alternatively, it is possible to keep the switch SW1 in an "OFF" state and the switch SW2 in an "ON" state to generate consecutively the primary discharge between the first electrode 103 and the second electrode 104 of the outer bulb 107 (i.e., in the secondary discharge path) so as to cause only the outer bulb 107 to be illuminated, thus permitting the selection of the bulb to be illuminated in the fluorescent lamp 101.

Hereunder, the fluorescent lamp according to the thirteenth embodiment of the present invention will be described. In this fluorescent lamp, the second electrode 104 is provided at the one end portion 106*a* of the inner bulb 106, in place of the one end portion 107*a* of the outer bulb 107 of the fluorescent lamp 101 as shown in FIG. 13. The remaining structural features are identical to those of the twelfth embodiment of the present invention, and detailed description thereof is therefore omitted.

Figure 16:
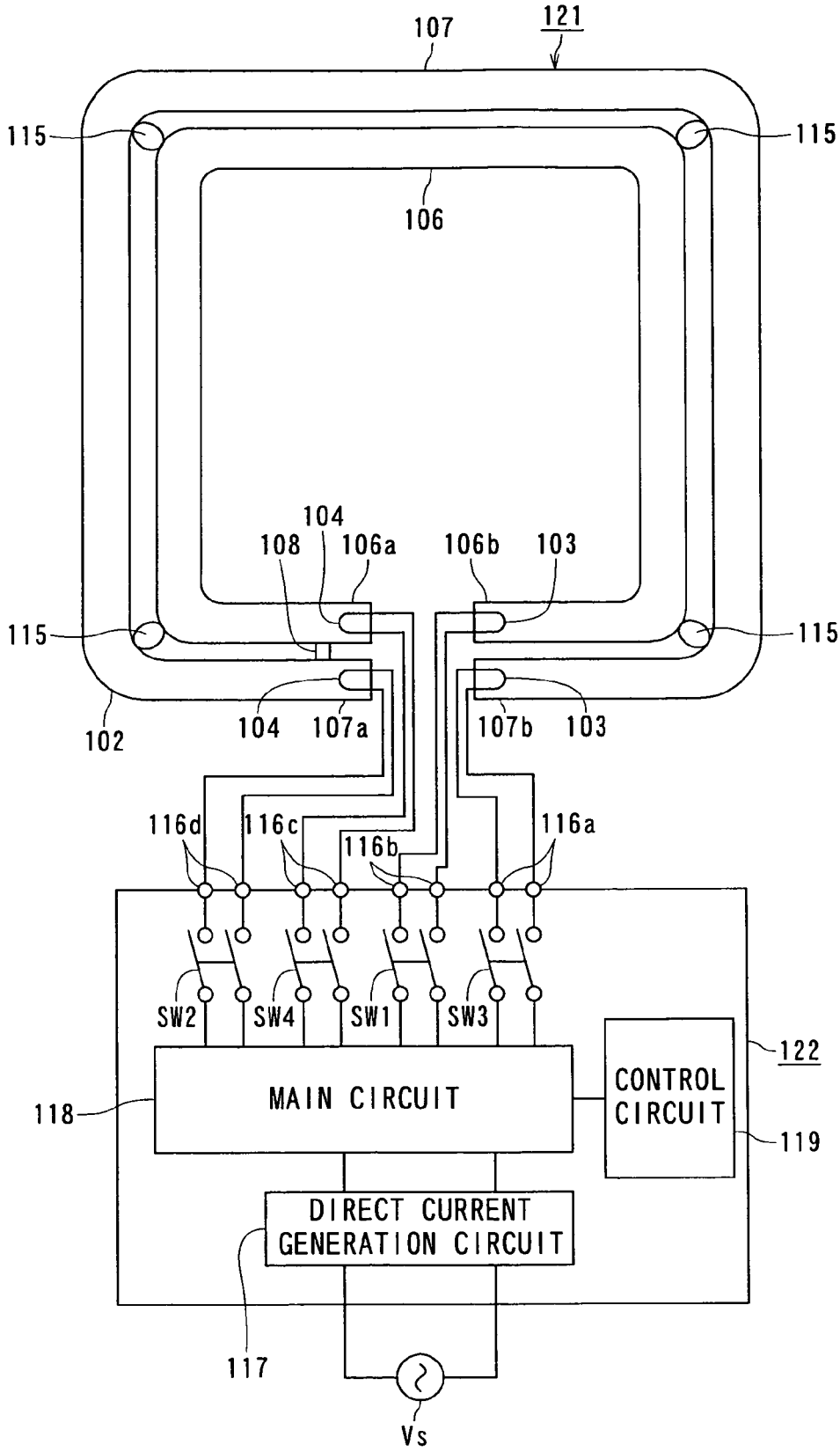
FIG. 16 is a view illustrating a front side of a fluorescent lamp according to a fourteenth embodiment of the present invention and a schematic block diagram of a high frequency lighting device of the present invention.

FIG. 16 is a schematic front view of the fluorescent lamp 121, partially broken away, according to the fourteenth embodiment of the present invention. The same reference numerals are given to the same components as those in FIG. 13, and the description relevant thereto will be omitted herein.

The fluorescent lamp 121 has a structure as shown in FIG. 16 in which the second electrode 104 is additionally provided at the one end portion 106*a* of the inner bulb 106, in the fluorescent lamp 101 as shown in FIG. 13.

The fluorescent lamp 121 is connected to the high frequency lighting device 122 shown in FIG. 16. More specifically, the output terminals 116*a*, 116*a*, 116*d*, 116*d* of the high frequency lighting device 122 are connected to the respective opposite ends of the first electrode 103 and the second electrode 104 of the outer bulb 107, and the output terminals 116*b*, 116*b*, 116*c*, 116*c* are connected to the respective opposite ends of the first electrode 103 and the second electrode 104 of the inner bulb 106. Switches SW1 to SW4 are disposed between the output terminals 116*a* to 116*d* and the main circuit 118 of the high frequency lighting device 122. With respect to the other structural features of the high frequency lighting device 122, it has the same structure as the high frequency lighting device 116 as shown in FIG. 15.

Operation is carried out in the same manner as described and illustrated in FIG. 15 to start the lighting for illumination of the fluorescent lamp 121. More specifically, discharge occurs between the first electrode 103 and the second electrode 104 of the outer bulb 107 (i.e., in the secondary discharge path), with the switches SW1 to SW3 kept in an "On" state and the switch SW4 in an "OFF" state. At this time, the switching operation has already been carried out by a switch, not shown, in the primary circuit 118 so that the second electrode 104 of the outer bulb 107 and the first electrode 103 of the inner bulb 106 have the same electrical potential. Then, the switch SW2 is kept in an "OFF" state to generate discharge between the pair of first electrodes 103, 103 of the illumination tube 102, thus providing subsequent illumination.

The switches SW1, SW3, SW4 may be kept in an "ON" state to apply the starting voltage to the secondary discharge path so as to generate discharge, and then, the switch SW4 may be kept in an "OFF" state to generate discharge in the primary discharge path in the similar manner.

In the fluorescent lamp 121 according to the embodiment of the present invention, the second electrode 104 and the first electrode 103 are disposed on the opposite end portions 106*a*, 106*b* of the inner bulb 106, respectively, and the second electrode 104 and the first electrode 103 are disposed on the opposite end portions 107*a*, 10*b* of the outer bulb 107, thus making it possible to cause the inner bulb 106 or the outer bulb 107 to be illuminated independently from each other in the form of a single fluorescent lamp. Supply of the high frequency voltage from the high frequency lighting device 122, with the switches SW2, SW3 kept in an "ON" state, and the switches SW1, SW4 kept in an "OFF" state, generates subsequently the primary discharge between the first electrode 103 and the second electrode 104 to illuminate the outer bulb 107. Alternatively, the high frequency voltage is supplied from the high frequency lighting device 122, with the switches SW1, SW4 kept in an "ON" state, and the switches SW2, SW3 kept in an "OFF" state, and subsequently, the primary discharge id generated between the first electrode 103 and the second electrode 104 to thereby illuminate the inner bulb 106.

Since the inner bulb 106 and the outer bulb 107 are provided with phosphor layers 105, which are different in luminescence color from each other, color of light radiated from the fluorescent lamp 121 changes. For example, in a case where the inner bulb 106 is provided on its inner surface with the phosphor layer having daylight color, and the outer bulb 107 is provided on its inner surface with the phosphor layer 105 having neutral white color, the illumination (luminescence) of the inner bulb 106 enables light having the daylight color to be radiated from the fluorescent lamp 121, the illumination of the outer bulb 107 enables light having the neutral white color to be radiated from the fluorescent lamp 121, and the illumination of the illumination tube 102 enables light having the intermediate between the daylight color and the neutral white color to be radiated from the fluorescent lamp 121.

In the thirteenth to fifteenth embodiments of the present invention, the second electrode 104 may be disposed as an auxiliary electrode for generating a discharge for start, without causing the primary discharge to be generated between the second electrode 104 and the first electrode 103. In the case where the second electrode is used as the auxiliary electrode, there is no need to use the filament electrode and a merely conductive body formed of wells or a cold cathode such as a nickel sleeve may be used.

Now, the sixteenth embodiment of the present invention will be described below.

Figure 17:
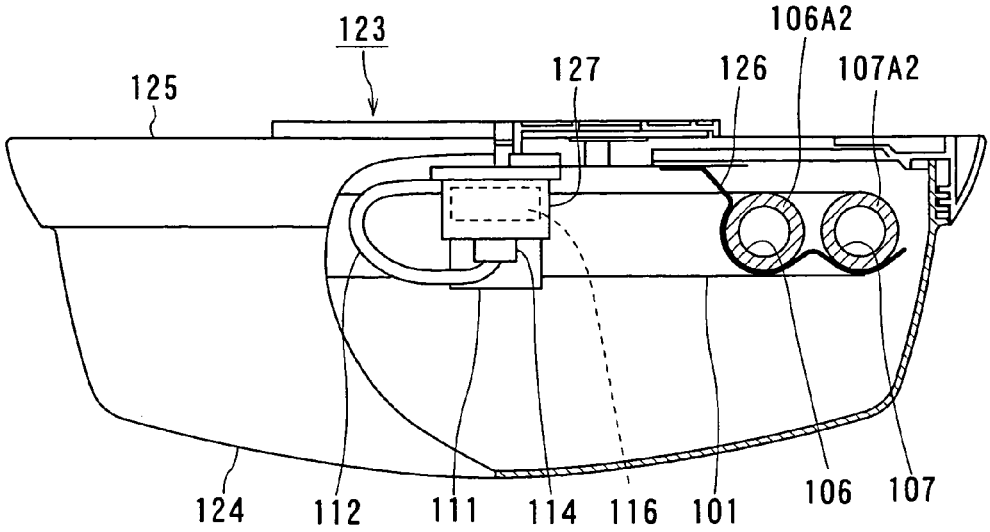
FIG. 17 is a schematic front view of a fluorescent lamp, partially cut away, according to a fifteenth embodiment of the present invention.

FIG. 17 is a schematic front view of a lighting apparatus 123, partially broken away, according to the fifteenth embodiment of the present invention. In FIG. 17, the same reference numerals are given to the same components as those in FIGS. 13 to 15 and the description relevant thereto will be omitted herein.

The lighting apparatus 123 as shown in FIG. 17, which is a surface mounted type with a glove 124 and to be mounted directly on a surface such as a ceiling surface, has a main body 125 is secured on the ceiling surface by means of screws. The main body 125 is provided with a plurality of lamp holders 126. The fluorescent lamp 101 is mounted on the main body 125 so that the straight tube portions 106A2, 107A2,—of the inner bulb 106 and the outer bulb 107 of the illumination tube 102 are supported by the lamp holders 126.

The main body 125 is provided with an adaptor 127. The high frequency lighting device 116 is received in the adaptor 127, which is connected to an external commercial alternating-current power supply. Connection pins 113 of the connector 114 are fitted into the adaptor 127 so that the high frequency lighting device 116 and the first and second electrodes 103, 104 of the fluorescent lamp 101 are connected to each other.

The high frequency lighting device 116 starts the lighting of the fluorescent lamp 101 at a low starting voltage so that the discharge is generated in the primary discharge path after the starting voltage has been applied to the secondary discharge path at the start of lighting of the fluorescent lamp 101 to generate discharge therein.

Figure 18:
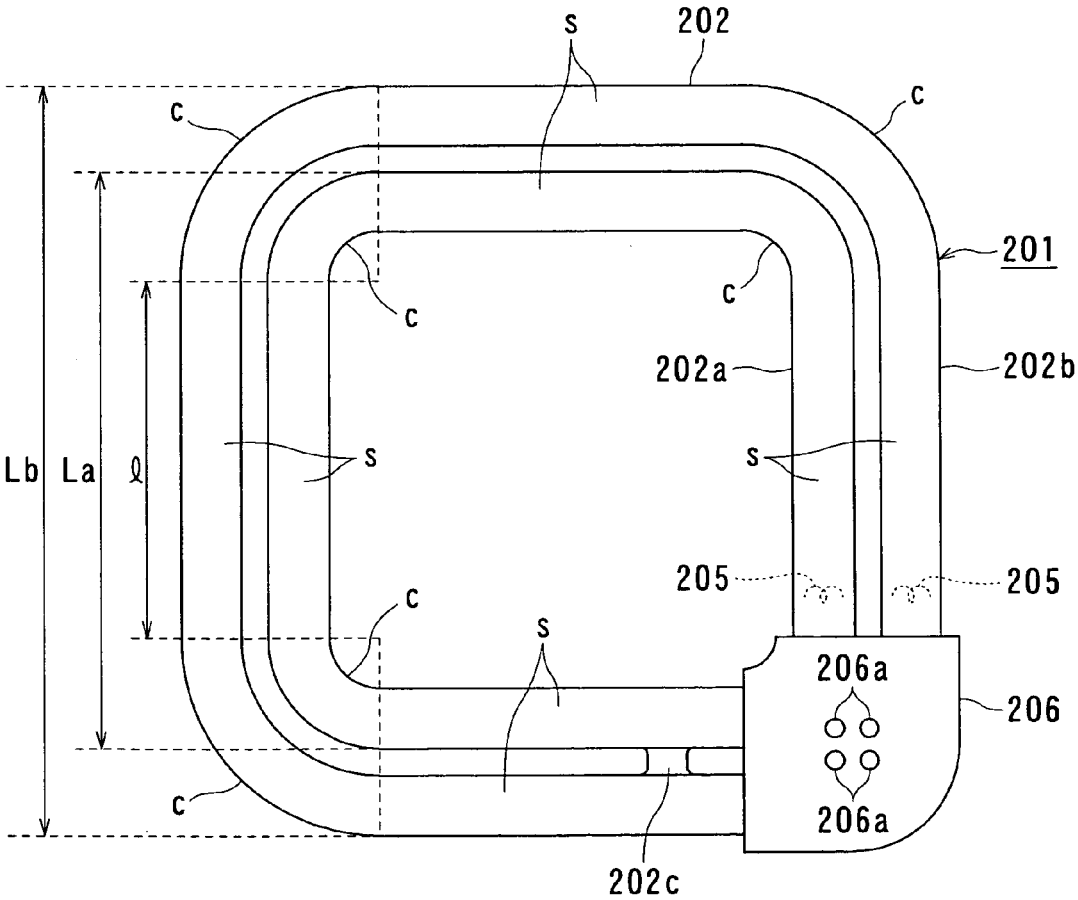
FIG. 18 is a front view of fluorescent lamp according to a sixteenth embodiment of the present invention.

FIG. 18 is a front view of the fluorescent lamp 201 according to the sixteenth embodiment of the present invention. The fluorescent lamp 201 includes a double-ringed illumination tube 202 composed of the inner ring bulb 202*a* and the outer ring bulb 202*b*, having the similar shape to each other so that the straight portions form substantially a square shape and their maximum ring diameters are different from each other. The ring glass bulbs 202*a*, 202*b* are connected to each other by means of a connection pipe 202*c* serving as the connection portion, so that these bulbs communicate with each other at the predetermined positions of the end portions thereof. The connection pipe 202*c* is formed by fusion-connecting protrusions provided in the form of a tubular body on the end portions of the bulbs 202*a*, 202*b* by a blast breaking process. The connection pipe 202*c* is formed apart from the ends of the bulbs 202*a*, 202*b* by the length of 2 to 15 mm so as to provide a space in which no discharge is generated.

Each of the ring glass bulbs 202*a*, 20*b* has four straight tube portions "S" and three bent portions "C" so that the four straight tube portions "S" are placed on the same plane so as to form the respective sides of the square shape structure. It is preferable that the length "La" of one side of the inner ring bulb 202*a* is 200 mm or more, and the length "La" of one side of the outer ring bulb 202*b* is 250 mm or more. In the embodiment of the present invention, "La" is about 250 mm, and "LB" is about 300 mm. It is preferable that the tube inside diameter of the straight tube portion "S" is within the range of from 12 to 20 mm and the thickness thereof is within the range of from 0.8 to 1.5 mm. In the embodiment of the present invention, the tube inside diameter is about 14 mm and the thickness is about 1.2 mm.

The ring bulbs 202*a*, 202*b* are combined concentrically to each other so that the centers thereof are placed in the same position and the corresponding bent portions "C" face in the same direction so as to away from the respective centers thereof. The ring bulbs 202*a*, 202*b* are connected to each other by means of the connection pipe 202*c* so that the centers of the corresponding bent portions 202*c* with radii of curvature are placed in substantially the same position.

Figure 19:
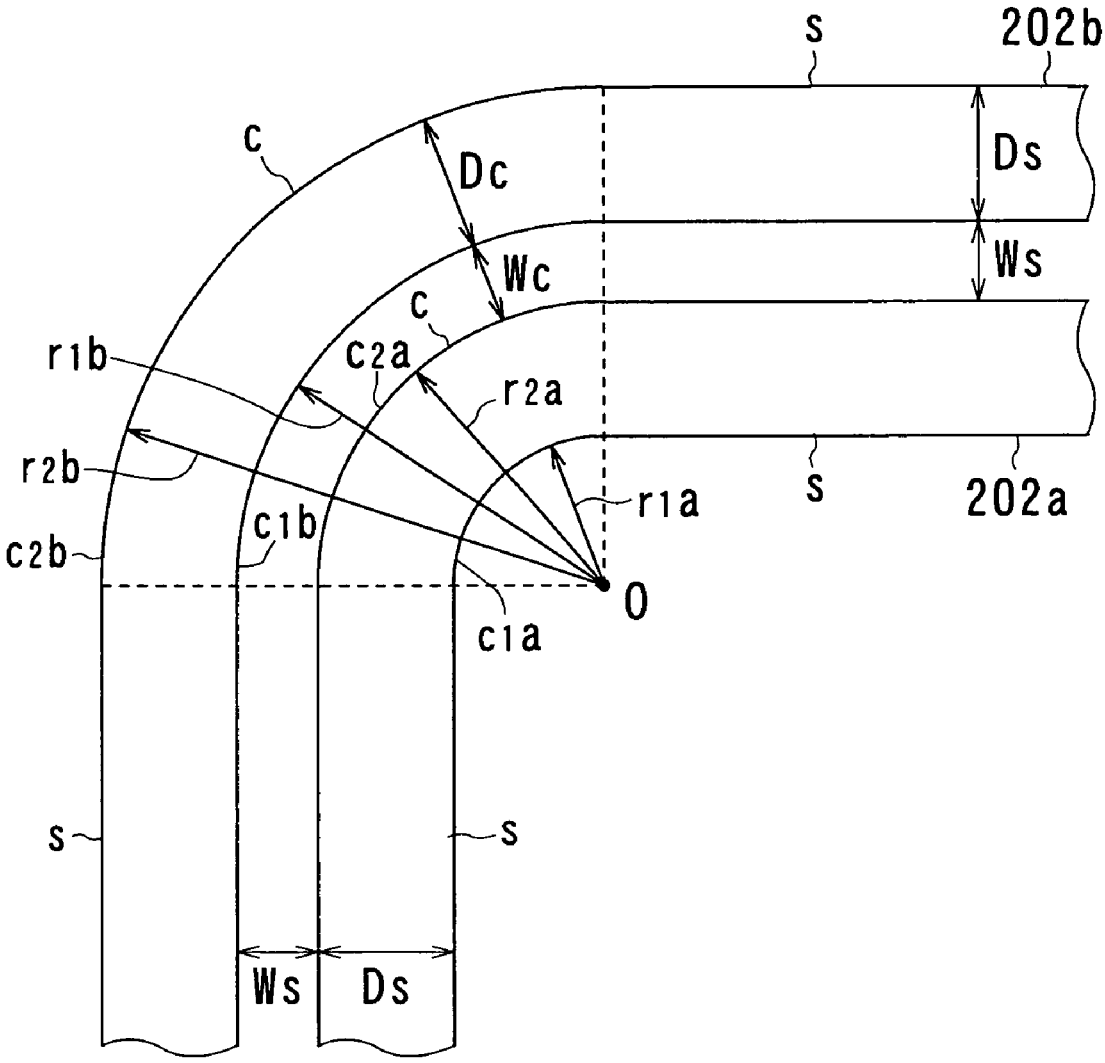
FIG. 19 is a front view of the fluorescent lamp, partially in an enlarged scale, as shown in FIG. 18.

FIG. 19 is an enlarged front view of a part of the bent portion "C". As shown in FIG. 19, the bent portion "C" is formed so that the center of radius of curvature "r1*a*" of the inner surface C11 of the inner ring bulb 202*c* having the smaller size, the center of radius of curvature "r2*a*" of the outer surface C2*a* thereof, the center of radius of curvature "r1*b*" of the inner surface C1*b* of the outer ring bulb 202*b* having the larger size, and the center of radius of curvature "r2*b*" of the outer surface thereof are placed substantially in the same point "O". The ring bulbs 202*a*, 202*b* are connected to each other to form the illumination tube 202.

The fluorescent lamp 201 is structured so that the centers of the corresponding bent portions "C" with radii of curvature are placed in the same position in the combination of the ring bulbs 202*a*, 202*b* having the sizes different from each other, thus making it possible to make a gap "Wc" between the adjacent bent portions "C" substantially equal to a gap between the adjacent straight tube portions, and improving an external appearance of the fluorescent lamp 201. Cushioning members made of silicone resin may be provided between the ring bulbs 202*a*, 202*b* to enhance the strength of the ring bulbs 202*a*, 202*b*. In this case, it is possible to limit the gaps "Ws" and "Wc" within the range of from 5.0 to 10.0 mm, taking into consideration the light radiation efficiency of the illumination tube 202 or productivity of the connection pipe 202*c*.

The bent portion "C" is formed by bending a straight tube bulb and then subjecting it to a molding formation process. The inner surfaces "C1*a*", "C1*b*" of the bent portions "C" mean surfaces, which face to the center of the imaginary circular curved surfaces formed by the ring bulbs 202*a*, 202*b*. The outer surfaces "C2*a*", "C2*b*" of the bent portions "C" mean surfaces, which are located on the side opposite to the inner surfaces "C1*a*", "C1*b*" of the bent portions "C" relative to the axial line of the tube by 180 degrees (i.e., surfaces that are radially in parallel with the circular curved surfaces formed by the ring bulbs 202*a*, 202*b*).

The radius of curvature "r1*a*", "r1*b*", "r2*a*", "r2*b*" can be defined by a curve, which is formed in a position at which the inner surface "C1*a*", "C1*b*" or the outer surface "C2*a*", "C2*b*" intersects the imaginary circular curved surface formed by the ring bulb 202. In a simple determination, it can be defined by a radius of curvature of an inner contour line or an outer contour line of the bent portion "C", when viewing the ring bulb 202*a*, 202*b* in the perpendicular direction to the imaginary circular curved surface formed by the ring bulb. The optimum range of the radius of curvature "r1*a*" is within the range of from 13 to 20 mm, the optimum range of the radius of curvature "r2*a*" is within the range of from 25 to 45 mm, the optimum range of the radius of curvature "r1*b*" is within the range of from 30 to 55 mm, and the optimum range of the radius of curvature "r2*b*" is within the range of from 45 to 70 mm. In the embodiment of the present invention, the radius of curvature "r1*a*" is 15 mm, the radius of curvature "r2*a*" is 31.5 mm, the radius of curvature "r1*b*" is 40 mm, and the radius of curvature "r2*b*" is 56.5 mm.

The tube diameter "Dc" of the bent portion "C" is substantially identical to the tube diameter "Ds" of the adjacent straight tube portion 202*b*. Such formation of the bent portions "C" causes a person to visually recognize as if the bent portions "C" of the ring bulbs 202*a*, 202*b* in its external appearance continue from the straight portion "S" to form a curved line. Therefore, an improved external appearance of the luminescent lamp 201 can be provided and there is no formation of a local area having a lower temperature, when illuminating. As a result, the cold spot cannot be generated easily, and the bent portion "C" is not susceptible to occurrence of blackening or stain due to condensed mercury. In the embodiment of the present invention, both of the tube diameter "Dc" of the bent portion and the tube diameter "Ds" of the straight tube portion 202*b* are 16.5 mm. The length "l" of the straight tube portion "S" is 237 mm.

Hereunder, a method of manufacturing the glass bulbs 202*a*, 202*b* used in the fluorescent lamp 201 according to the embodiment of the present invention will be described.

First, there is prepared a single straight bulb on which the protective layer and the phosphor layer have previously formed. One end of the bulb is closed, and the electrode is disposed in the other end of the straight tube bulb through a flare stem, which has a discharge pipe and introduces a pair of lead wires.

The straight tube bulb has the total length of from 1200 to 1500 mm and three bent-portion-formation prearrangement portions. Each of these prearrangement portions has the length of about 90 mm, and the total length of three prearrangement portions 202*e* is 270 mm, which is about 18 to 23% of the total length of the straight tube bulb 202*a*.

The straight bulbs having the length applicable to the shape of each of the glass bulbs 202*a*, 202*b* is heated at the respective bent-portion-formation prearrangement portions to soften, bent so that an angle between the straight tube portions is about 90 degrees, and then subjected to a molding process to form three bent portions having the predetermined shape. The glass bulbs 202*a*, 202*b* are blast-broken at the predetermined positions of the respective ends thereof to form tubular bodies projecting therefrom and these tubular bodies are fusion-connected to each other so as to from a connection pipe 2*c*. Air is discharged from the discharge pipes and then mercury is charged to complete the manufacture of the double-ringed fluorescent pipe 202. In such a fluorescent pipe 202, the ring bulbs 202*a*, 202*b* communicate with each other through the connection pipe 202*c*, with the result that a single discharge path having the double-ringed structure in which one round having a square shape is connected at the one end thereof to the other round.

The bent portion "C" is formed by a bent formation process, but there is no need to excessively heat the other portions of the straight bulb than the bent-portion-formation prearrangement portions. Accordingly, even when the phosphor layer is formed through a coating (application) process before the formation of the bent portion "C", the phosphor layer is not susceptible to thermal deterioration and the luminous flux maintenance factor can be improved remarkably, thus providing advantageous effects. These effects can be remarkably provided when the total length of the bent-portion-formation prearrangement portions is up to 50% of the total length of the straight tube bulb, preferably up to 30% thereof, and most preferably, up to 20% thereof.

Now, this embodiment of the present invention will operate as follows.

The high frequency voltage is inputted from the base 206 to illuminate the fluorescent lamp 201 through discharge of mercury vapor having a low pressure. The fluorescent lamp 201 is illuminate so that the luminous input power is at least 40 W, the luminous current is at least 200 mA, the tube wall load is at least 0.05 W/cm$^2$, and the luminous efficiency is at least 501 m/W. The luminous electric density, which is the luminous current per cross-section of the straight tube portion 202*b*, is at least 75 A/cm$^2$. In the embodiment of the present invention, the luminous input power is 60 W, the luminous current is 380 mA and the luminous efficiency is 901 m/W.

The temperature of the bulb 202 increases to about 80° C., when the fluorescent lamp 201 is illuminated. However, the portion of the fluorescent lamp 201, which is shifted from the connection portion 202*c* toward the end side of the lamp, serves as a non-discharge generation zone to generate the cold spot having the optimum temperature. Accordingly, the pressure of mercury vapor in the bulbs 202*a*, 202*b* is kept proper, thus permitting illumination at the high efficiency.

The specific features of the fluorescent lamp 201 of the present invention will be described below. The present inventors have carried out extensive studies about a balance between the luminous power and formability of the bent portion "C" and obtained findings that it is preferable that the length "l" of the straight tube portion "S" is within the range of from 150 to 500 mm, and the radius of curvature "r1" (r1*a* and r1*b*) of the inner surfaces C1*a*, C1*b* of the bent portion satisfies the relational expression of "0.03≦r1/l≦0.3. With the ratio "r1/l" of the radius of curvature "r1" of the inner surface of the bent portion relative to the length "l" of the straight tube portion "S" of less than 0.03, a degree of deformation of the bent portion becomes large, resulting in the difficulty in manufacture and decrease in strength. On the other hand, with the ratio "r1/l" of over 0.3, the ratio of the bent portion relative to the ring bulb increases, resulting in that the influence due to deterioration of the phosphor layer in the bent portion "C" caused by heat becomes large, thus leading to a reduced luminous efficiency. Therefore, such a condition is not acceptable. In the fluorescent lamp 201, the length "l" of the straight tube portion "S" of each of the ring bulbs 202*a*, 202*b* is 237 mm within the range of from 150 to 500 mm, the radius of curvature "r1*a*" of the inner surface "C1*a*" of the inner ring bulb 202*a* is 15 mm, and the radius of curvature "r1*b*" of the inner surface "C1*b*" of the outer ring bulb 202*a* is 40 mm. Accordingly, "r1*a*/l" is about 0.06 and "r1*b*/l" is about 0.16, which satisfy the above-mentioned relational expression of "0.03≦r/l≦0.3".

In the fluorescent lamp according to the embodiment of the present invention, the centers of the inner surfaces C1*a*, C1*b* and outer surfaces C2*a*, C2*b*, having the respective radii of curvature "r1*a*", "r1*b*", "r2*a*", "r2*b*", are placed substantially in the same position, thus making it possible to cause a person to visually recognize as if the bent portions "C" of the ring bulbs 202*a*, 202*b* in their external appearance continue from the straight tube portion "S" to form a curved line, thus improving an external appearance of the illumination tube 202. In addition, it is possible to make the gap "Wc" between the adjacent bent portions substantially equal to the gap "Ws" between the straight tube portions and to improve the external appearance in comparison with a case where a plurality of ring bulbs are combined together so as to make the radii of curvature of the inner surfaces of the bent portions equal to each other. A uniform brightness can also be provided.

In addition, the radii of curvature "r1 (r1*a* and r1*b*)" of the inner surfaces "C1*a*, C1*b*" of the bent portion "C" satisfy the expression of "0.03≦r/l≦0.3" in the case where the length "l" of the straight tube portion "S" of the illumination tube 202 is within the range of from 150 to 500 mm, thus making it possible to form easily the bent portion "C" and minimize the influence due to the deterioration of the phosphor of the bent portion "C", which is caused by heat, to utilize effectively the luminous power from the straight tube portion "S".

Figure 20:
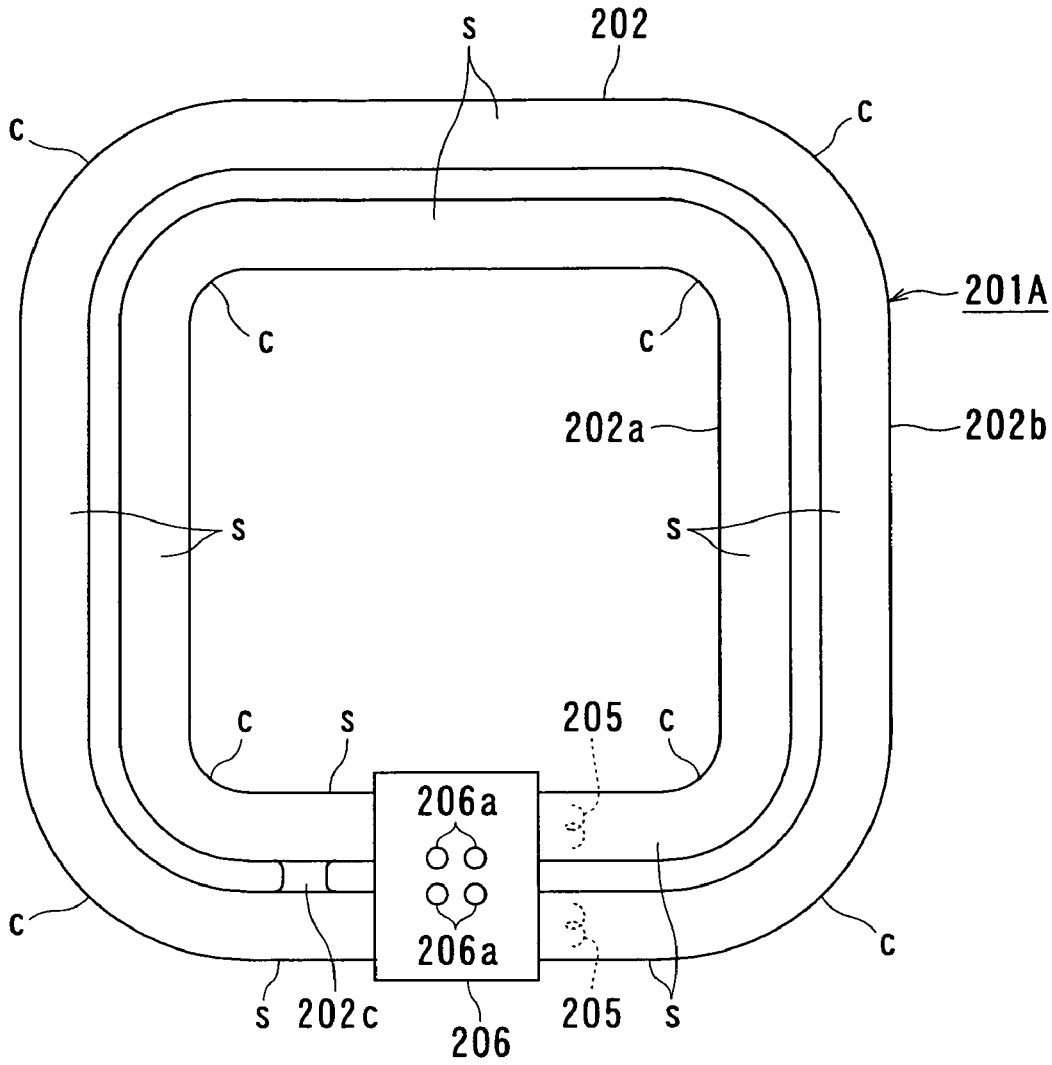
FIG. 20 is a front view of a fluorescent lamp according to a seventeenth embodiment of the present invention.

FIG. 20 is a front view of the fluorescent lamp 201A according to the seventeenth embodiment of the present invention. The seventeenth embodiment is identical to the sixteenth embodiment as shown in FIG. 19 except that the base 206 is placed in the middle of one side of the square shape. Each of the glass bulbs 202*a*, 202*b* has five straight portions "S" and four bent portions "C". The base 206 is placed so as to straddle a space between the respective opposite ends of the ring bulbs 202*a*, 202*b* in which the respective axial lines are aligned with each other. The base 206 is disposed at the intermediate portion of one side of each of the bulbs 202*a*, 202*b* having the square shape.

INDUSTRIAL APPLICABILITY

According to the present invention, each of the inner and outer bulbs are formed by heating a single elongated straight bulb having the inner surface on which layers such as a phosphor layer has previously formed locally only at bent-portion-formation prearrangement portions, and alternatively, heating only the corresponding ends of a plurality of straight bulbs, which are to be connected to form the connection portion, and the remaining portions of the bulb are not subjected to a heating process. It is therefore possible to control strain caused by the heating of the whole inner and outer ring bulbs, and increase the strength.

Even in the case where the connection portion is formed by subjecting the corresponding one ends of the inner and outer bulbs through a burner blast breaking process, the inner and outer bulbs generally have low strain controlled as described above, thus increasing the strength of the connection portion.

In addition, the discharge path sections of the inner and outer bulbs are connected to each other through the connection portion to form a single discharge path so as to increase the length of the discharge path, thus enhancing the total luminous flux and the luminous efficiency.

Further, in the present invention, the distance between one of the paired electrodes and the second electrode is smaller than the distance between the paired electrodes. When, prior to the occurrence of discharge between the pair of first electrodes of the illumination tube to illuminate the fluorescent lamp, the discharge is caused to occur between the first electrode and the second electrode of the bulb, and the discharge is then caused to occur between the pair of first electrodes of the illumination tube, the starting voltage for the illumination tube can be reduced. Alternatively, it is possible to cause a primary discharge for illumination to occur only between the first electrode and the second electrode of the bulb, to provide a dimmer illumination of the fluorescent lamp.

In addition, according to the present invention, when the centers of the radii of curvature of the respective bent portions of the inner and outer bulbs, which are connected concentrically to each other, it is possible to make the gap between the adjacent bent portions substantially equal to the gap between the straight tube portions, thus improving the external appearance and providing a uniform brightness.

The invention claimed is:

1. A fluorescent lamp comprising:

a multi-ringed bulb including:

a plurality of ring bulbs in which a plurality of straight tube portions, each having an outside diameter of from 12 to 20 mm, are connected to each other through bent portions on a same plane, said ring bulbs being placed concentrically on the same plane;

electrodes provided hermetically at respective ends of outermost and innermost bulbs of the plurality of ring bulbs; and a connection portion connecting other adjacent ends of the outermost and innermost bulbs to each other so that the outermost and innermost bulbs communicate with each other to thereby form a single discharge path;

a phosphor layer formed on inner surfaces of at least the straight tube portions of the multi-ringed bulb; and a discharge medium with which the multi-ringed bulb is filled, wherein each of the straight tube portions has a length "l " of from 150 to 500 mm, and a radius of curvature "r " of the bent portion satisfies an expression of 0.03 ≦r/l ≦0.3.

2. The fluorescent lamp according to claim 1, wherein each of the multi-ringed bulbs is formed by bending a single straight tube bulb member, said straight tube bulb member having a tube length of from 800 to 2500 mm, a length of a bent-portion-formation prearrangement portion, which is to be formed into the bent portion, being within a range of from 5 to 50% of a total length of the straight tube bulb member.

3. The fluorescent lamp according to claim 1, wherein said multi-ringed bulb comprises a double-tube bulb having inner and outer bulbs, electrode-side outer ends of the inner and outer bulbs at which a pair of electrodes are hermetically provided, respectively and other outer ends of the bulbs, which has the connection portion, are spaced apart from each other by a predetermined distance so as to face each other, and a base is disposed on one ends and other ends of the bulbs so as to cover respective end portions thereof.

4. The fluorescent lamp according to claim 3, wherein the inner and outer bulbs connected to each other through the connection portion are cut by fusion at the other outer end portions thereof and closed hermetically, and a minimum length from the outer end portions to the connection portion is equal to or less than 15 mm.

5. The fluorescent lamp according to claim 3, wherein each of the inner and outer bulbs is formed into a rectangular shape and both electrode-side ends of the inner and outer bulbs extend to corners of the rectangular shape.

6. The fluorescent lamp according to claim 3, the bulbs are filled with mercury vapor serving as the discharge medium, the connection portion is provided so that a least a part of the connection portion is substantially flush with the other outer end portions of the inner and outer bulbs, and the electrode for the outer bulb is positioned at a position apart from the end of the bulb by a distance, which is larger than a distance by which the electrode for the inner bulb is positioned at a position apart from the end of the bulb.

7. The fluorescent lamp according to claim 3, wherein the electrode-side outer end of at least one of the inner and outer bulbs terminates at a position, which is disposed on an inner side in an axial direction of the bulb relative to the electrode-side outer end of the other bulb, and electricity receiving devices are disposed on an outer surface of the base covering both the electrode-side outer end portions of the inner and outer bulbs corresponding to positions in a space extending outward from the electrode-side outer end portion of the one of the inner and outer bulbs in the axial direction thereof.

8. The fluorescent lamp according to claim 3, further comprising a second electrode disposed at the end of the bulb corresponding to an intermediate position of the discharge path.

9. The fluorescent lamp according to claim 3, wherein centers of radii of curvature of inner and outer surfaces of bent portions of the inner and outer bulbs substantially coincide with each other and the bent portions have a diameter, which is substantially identical to the diameter of the straight tube portions disposed in a vicinity of the bent portions.

10. The fluorescent lamp according to claim 3, wherein each of the inner and outer bulbs is formed into a rectangular shape by four straight tube portions, three bent portions are arranged at three diagonal positions of the rectangular shape and the base is disposed at a remaining one diagonal position thereof.

11. The fluorescent lamp according to claim 3, wherein each of the inner and outer bulbs is formed into a rectangular shape by five straight tube portions, bent portions are arranged at diagonal positions of the rectangular shape and the base is disposed at a central position of one side of the rectangular shape.

12. A lighting apparatus comprising:

a main body;

a plurality of fluorescent lamps recited in claim 3; and a high frequency lighting circuit, which supplies lamp electricity to the fluorescent lamps at a high frequency of at least 10 kHz.

* * * * *